US012590515B2

(12) United States Patent
Knight et al.

(10) Patent No.: US 12,590,515 B2
(45) Date of Patent: Mar. 31, 2026

(54) REUSABLE PERFORATING GUN SYSTEM AND METHOD

(71) Applicant: G&H Diversified Manufacturing LP, Houston, TX (US)

(72) Inventors: Benjamin Vascal Knight, Katy, TX (US); James Edward Kash, Houston, TX (US); Joe Noel Wells, Lindale, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 19/055,094

(22) Filed: Feb. 17, 2025

(65) Prior Publication Data

US 2025/0198262 A1 Jun. 19, 2025

Related U.S. Application Data

(63) Continuation of application No. 18/506,438, filed on Nov. 10, 2023, now Pat. No. 12,252,965, which is a continuation of application No. 17/572,379, filed on Jan. 10, 2022, now Pat. No. 11,851,993, which is a continuation of application No. 17/157,503, filed on Jan. 25, 2021, now Pat. No. 11,236,591, which is a continuation of application No. 16/786,445, filed on Feb. 10, 2020, now Pat. No. 10,900,334.

(Continued)

(51) Int. Cl.

| | |
|---|---|
| ***E21B 43/1185*** | (2006.01) |
| ***E21B 23/00*** | (2006.01) |
| ***E21B 23/06*** | (2006.01) |
| ***E21B 43/117*** | (2006.01) |
| ***E21B 43/119*** | (2006.01) |
| ***F42D 1/05*** | (2006.01) |

(52) U.S. Cl.

CPC ..... *E21B 43/1185* (2013.01); *E21B 23/00* (2013.01); *E21B 23/065* (2013.01); *E21B 43/117* (2013.01); *E21B 43/119* (2013.01); *F42D 1/05* (2013.01)

(58) Field of Classification Search

CPC ..... E21B 29/02; E21B 43/1185; F42D 1/05

See application file for complete search history.

(56) References Cited

U.S. PATENT DOCUMENTS

| | | | | |
|---|---|---|---|---|
| 9,689,237 | B2 * | 6/2017 | Johnson | E21B 33/134 |
| 10,077,626 | B2 * | 9/2018 | Xu | E21B 43/116 |

(Continued)

*Primary Examiner* — Kenneth L Thompson

(74) *Attorney, Agent, or Firm* — Conley Rose, P.C.

(57) ABSTRACT

A tool string includes a perforating gun, a first electrical connector defining a receptacle and includes a first electrical contact positioned in the receptacle, and a sub including a sub housing including first end, a second end opposite the first end, and a central passage extending between the first end and the second end, and a bulkhead connector positionable in the central passage to form a pressure barrier along the central passage, the bulkhead connector including an outer housing defining a radially outer periphery of the bulkhead connector, and a second electrical contact positioned along the outer periphery of the bulkhead connector and configured to establish radially directed electrical contact with the first electrical contact of the first electrical connector irrespective of the angular orientation of the second electrical contact relative to the first electrical contact.

20 Claims, 21 Drawing Sheets

Related U.S. Application Data

(60) Provisional application No. 62/803,222, filed on Feb. 8, 2019.

(56) References Cited

U.S. PATENT DOCUMENTS

| | | | | |
|---|---|---|---|---|
| 10,151,181 | B2 * | 12/2018 | Lopez | E21B 43/1185 |
| 10,704,354 | B2 * | 7/2020 | Hamid | E21B 43/26 |
| 10,731,430 | B2 * | 8/2020 | LaGrange | E21B 43/119 |
| 10,900,334 | B2 * | 1/2021 | Knight | E21B 43/119 |
| 11,236,591 | B2 * | 2/2022 | Knight | E21B 43/1185 |
| 11,851,993 | B2 * | 12/2023 | Knight | F42D 1/05 |
| 12,252,965 | B2 * | 3/2025 | Knight | F42D 1/05 |
| 2025/0198262 | A1 * | 6/2025 | Knight | E21B 43/1185 |

* cited by examiner

REUSABLE PERFORATING GUN SYSTEM AND METHOD

CROSS-REFERENCE TO RELATED APPLICATIONS

This application is a continuation of U.S. non-provisional patent application Ser. No. 18/506,438 filed Nov. 10, 2023, entitled "Reusable Perforating Gun System and Method", which is a continuation of U.S. non-provisional patent application Ser. No. 17/572,379 filed Jan. 10, 2022, entitled "Reusable Perforating Gun System and Method", now U.S. Pat. No. 11,851,993, issued Dec. 26, 2023, which is a continuation of U.S. non-provisional patent application Ser. No. 17/157,503 filed Jan. 25, 2021, entitled "Reusable Perforating Gun System and Method", now U.S. Pat. No. 11,236,591, issued Feb. 1, 2022, which is a continuation of U.S. non-provisional patent application Ser. No. 16/786,445 filed Feb. 10, 2020, now U.S. Pat. No. 10,900,334, issued Jan. 26, 2021, entitled "Reusable Perforating Gun System and Method", which claims benefit of U.S. provisional patent application No. 62/803,222 filed Feb. 8, 2019, and entitled "Digital Perforating Gun System" all of which are hereby incorporated herein by reference in their entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, once the downhole plug has been set and the casing string has been perforated by the perforating gun, a ball or dart may be pumped into the wellbore for landing against the set downhole plug, thereby isolating the portion of the wellbore extending uphole from the set downhole plug. With this uphole portion of the wellbore isolated, the formation extending about the perforated section of the casing string may be hydraulically fractured by fracturing fluid pumped into the wellbore.

SUMMARY

An embodiment of a tool string for perforating a tubular string positioned in a wellbore comprises a perforating gun configured to selectably form perforations in the tubular string, a first electrical connector configured to couple with the perforating gun, wherein the first electrical connector defines a receptacle and comprises a first electrical contact positioned in the receptacle, a sub configured to couple with the perforating gun, wherein the sub comprises a sub housing comprising first end, a second end opposite the first end, and a central passage extending between the first end and the second end, and a bulkhead connector positionable in the central passage to form a pressure barrier along the central passage, the bulkhead connector comprising an outer housing defining a radially outer periphery of the bulkhead connector, and a second electrical contact positioned along the outer periphery of the bulkhead connector and configured to establish radially directed electrical contact with the first electrical contact of the first electrical connector irrespective of the angular orientation of the second electrical contact relative to the first electrical contact. In some embodiments, the first electrical contact comprises an annular electrical contact extending circumferentially around the outer periphery of the bulkhead connector when the bulkhead connector is electrically connected to the first electrical connector. In some embodiments, a longitudinal end of the bulkhead connector is receivable in the receptacle of the first electrical connector to establish electrical contact between the first electrical contact and the second electrical contact. In certain embodiments, the bulkhead connector comprises one or more annular seal assemblies are positioned along the outer periphery thereof to seal against an inner surface of the sub defining the central passage thereof. In certain embodiments, the bulkhead connector comprises a third electrical contact located at a longitudinal end of the bulkhead connector. In some embodiments, the third electrical contact is positioned along a longitudinal axis of the bulkhead connector. In some embodiments, the bulkhead connector comprises a fourth electrical contact located at an opposing longitudinal end of the bulkhead connector and which is electrically connected to the third electrical contact. In certain embodiments, the second electrical contact is positioned longitudinally between the third electrical contact and the fourth electrical contact. In certain embodiments, the tool string comprises a second electrical connector separate from the first electrical connector and configured to couple with the perforating gun and comprising a fourth electrical contact electrically connectable to the third electrical contact of the bulkhead connector. In some embodiments, the second electrical connector is releasably connectable to the longitudinal end of the bulkhead connector.

An embodiment of a tool string for perforating a tubular string positioned in a wellbore comprises a perforating gun configured to selectably form perforations in the tubular string, a first electrical connector configured to couple with the perforating gun, wherein the first electrical connector defines a receptacle and comprises an annular first electrical contact positioned in the receptacle, a sub configured to couple with the perforating gun, wherein the sub comprises a sub housing comprising first end, a second end opposite the first end, and a central passage extending between the first end and the second end, and a bulkhead connector positionable in the central passage to form a pressure barrier along the central passage, the bulkhead connector comprising an outer housing defining a radially outer periphery of the bulkhead connector, a second electrical contact positioned along the outer periphery of the bulkhead connector and configured to establish radially directed electrical contact with the first electrical contact with the first electrical contact extending circumferentially around the outer periphery of the bulkhead connector. In certain embodiments, the second electrical contact projects radially outwards from the outer housing of the bulkhead connector. In certain embodiments, a longitudinal end of the bulkhead connector is receivable in the receptacle of the first electrical connector to establish electrical contact between the first electrical contact and the second electrical contact. In some embodiments, the bulkhead connector comprises one or more annular seal assemblies are positioned along the outer periphery thereof to seal against an inner surface of the sub defining the central passage thereof. In some embodiments, the bulkhead connector comprises a third electrical contact located at a longitudinal end of the bulkhead connector. In certain embodiments, the tool string comprises a second electrical connector separate from the first electrical connector and configured to couple with the perforating gun and comprising a fourth electrical contact electrically connectable to the third electrical contact of the bulkhead connector.

An embodiment of a tool string for perforating a tubular string positioned in a wellbore comprises a perforating gun configured to selectably form perforations in the tubular string, a first electrical connector configured to couple with the perforating gun, wherein the first electrical connector defines a receptacle and comprises an annular first electrical contact positioned in the receptacle, a second electrical connector separate from the first electrical connector and configured to couple with the perforating gun and comprising a second electrical contact, a sub configured to couple with the perforating gun, wherein the sub comprises a sub housing comprising first end, a second end opposite the first end, and a central passage extending between the first end and the second end, and a bulkhead connector positionable in the central passage to form a pressure barrier along the central passage, the bulkhead connector comprising an outer housing defining a radially outer periphery of the bulkhead connector, a third electrical contact positioned along the outer periphery of the bulkhead connector and configured to establish radially directed electrical contact with the first electrical contact, and a fourth electrical contact positioned at a longitudinal end of the bulkhead connector and configured to establish longitudinally directed electrical contact with the second electrical contact. In certain embodiments, the fourth electrical contact is spaced radially inwards from the radially outer periphery of the bulkhead connector. In some embodiments, the bulkhead connector comprises a fifth electrical contact positioned at an opposing longitudinal end of the bulkhead connector and electrically connected to the fourth electrical contact. In some embodiments, the third electrical contact is located longitudinally between the fourth electrical contact and the fifth electrical contact. In certain embodiments, the fourth electrical contact is positioned along a longitudinal axis of the bulkhead connector. In certain embodiments, the first electrical contact comprises an annular electrical contact.

BRIEF DESCRIPTION OF THE DRAWINGS

For a detailed description of exemplary embodiments of the disclosure, reference will now be made to the accompanying drawings in which.

DETAILED DESCRIPTION

Figure 1:
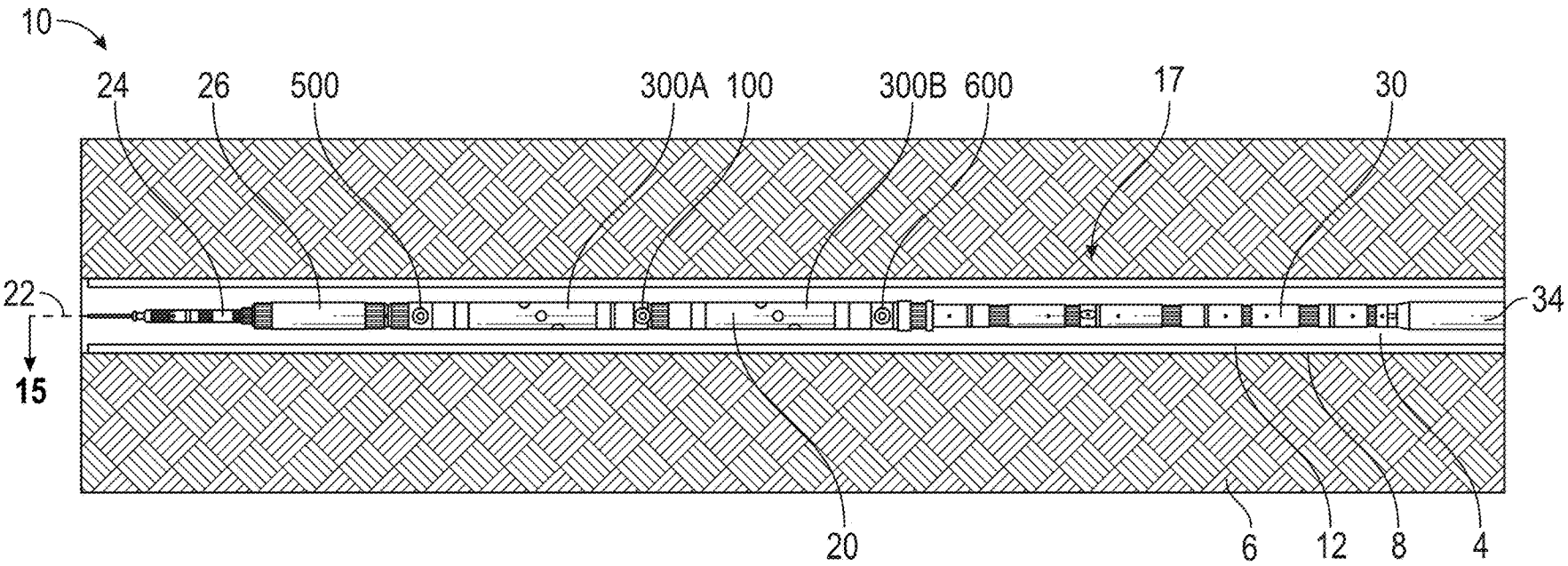
FIG. 1 is a schematic, partial cross-sectional view of a system for completing a subterranean well including a tool string in accordance with the principles disclosed herein.
Figure 2:
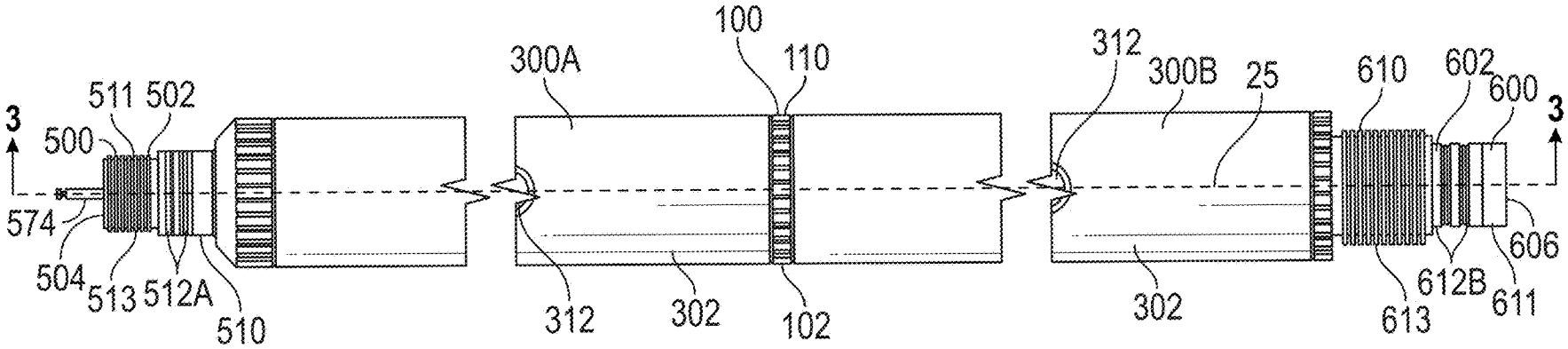
FIG. 2 is a side view of embodiments of a direct connect sub, a first perforating gun, a switch sub, a second perforating gun, and a plug-shoot firing head of the tool string of FIG. 1 in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, a system 10 for completing a wellbore 4 extending into a subterranean formation 6 is shown. In the embodiment of FIG. 1, wellbore 4 is a cased wellbore including a tubular casing string 12 secured to an inner surface 8 of the wellbore 4 using cement (not shown). In some embodiments, casing string 12 generally includes a plurality of tubular segments coupled together via a plurality of casing collars. In this embodiment, completion system 10 includes a wireline deployable digital gun system or tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and a control system or firing panel 15 (shown schematically in FIG. 1) positioned at the surface.

In some embodiments, system 10 may further include suitable surface equipment for drilling, completing, and/or operating completion system 10 and may include, for example, derricks, structures, reels, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 has a central or longitudinal axis 25 and generally includes a cable head 24, a casing collar locator (CCL) 26, a direct connect sub 500, a plurality of perforating guns 300A, 300B, a switch sub 100, a plug-shoot firing head 600, a setting tool 30, and a downhole or frac plug 34. Cable head 24 is the uppermost component of tool string 20 and includes an electrical connector for providing electrical signal and power communication between the wireline 22 and the other components (CCL 26, perforating guns 300A, 300B, setting tool 30, etc.) of tool string 20. CCL 26 is coupled to a lower end of the cable head 24 and is generally configured to transmit an electrical signal to the surface via wireline 22 when CCL 26 passes through a casing collar, where the transmitted signal may be recorded at the surface as a collar kick to determine the position of tool string 20 within wellbore 4 by correlating the recorded collar kick with an open hole log. The direct connect sub 500 (shown schematically in FIG. 1) is coupled to a lower end of CCL 26 and is generally configured to provide a connection between the CCL 26 and the portion of tool string 20 including the perforating guns 300A, 300B and associated tools, such as the setting tool 30 and downhole plug 34.

Perforating guns 300A, 300B (shown schematically in FIG. 1) of tool string 20 are coupled to direct connect sub 500 and are generally configured to perforate casing string 12 and provide for fluid communication between formation 6 and wellbore 4. Particularly, perforating guns 300A, 300B each include a plurality of perforating or shaped charges that may be detonated by a signal conveyed by the wireline 22 to produce an explosive jet directed against casing string 12. In some embodiments, perforating guns 300A, 300B may comprise a hollow steel carrier (HSC) type perforating gun, a scalloped perforating gun, a retrievable tubing gun (RTG) type perforating gun, as well as other types of perforating guns. In addition, each perforating gun 300A, 300B may comprise a wide variety of sizes such as, for example, 2¾", 3⅛", or 3⅜", wherein the above listed size designations correspond to an outer diameter of perforating guns 300A, 300B.

In this embodiment, switch sub 100 (shown schematically in FIG. 1) of tool string 20 is coupled between the pair of perforating guns 300A, 300B and includes an electrical conductor and switch generally configured to allow for the passage of an electrical signal to a lower perforating gun 300B of tool string 20. Tool string 20 further includes plug-shoot firing head 600 (also shown schematically in FIG. 1) coupled to a lower end of the lower perforating gun 300B. Plug-shoot firing head 600 couples the perforating guns 300A, 300B of the tool string 20 to the setting tool 30 and downhole plug 34, and, as will be described further herein, is generally configured to pass a signal from the wireline 22 to the setting tool 30 of tool string 20. In this embodiment, plug-shoot firing head 600 also includes electrical components to fire the setting tool 30 of tool string 20.

In this embodiment, tool string 20 further includes setting tool 30 and downhole plug 34, where setting tool 30 is coupled to a lower end of plug-shoot firing head 600 and is generally configured to set or install downhole plug 34 within casing string 12 to isolate desired segments of the wellbore 4, as will be discussed further herein. Once downhole plug 34 has been set by setting tool 30, an outer surface of downhole plug 34 seals against an inner surface of casing string 12 to restrict fluid communication through wellbore 4 across downhole plug 34. Downhole plug 34 of tool string 20 may be any suitable downhole or frac plug known in the art while still complying with the principles disclosed herein. Although in this embodiment tool string 20 generally includes cable head 24, CCL 26, direct connect sub 500, perforating guns 300A, 300B, switch sub 100, plug-shoot firing head 600, setting tool 30, and downhole or frac plug 34, in other embodiments, the configuration of tool string 20 may vary. For instance, in some embodiments, tool string 20 may comprise weight bars and/or a fish neck at an upper or uphole end thereof. In certain embodiments, tool string 20 may comprise a release tool for releasing at least a portion of tool string 20 in the event that tool string 20 becomes stuck in wellbore 4. In some embodiments, tool string 20 may also comprise a safety sub.

Referring to FIGS. 2-5, embodiments of the switch sub 100, perforating guns 300A, 300B, direct connect 500, and plug-shoot firing head 600 of the tool string 20 of FIG. 1 are shown in FIGS. 2-5. In the embodiment of FIGS. 2-5, tool string 20 includes a first or upper perforating gun 300A coupled between direct connect 500 and switch sub 100, and a second or lower perforating gun 300B connected between switch sub 100 and plug-shoot firing head 600; however, in other embodiments, tool string 20 may comprise varying numbers of switch subs 100, and perforating guns 300A, 300B, and/or direct connect sub 500 positioned in varying configurations, as well as additional components besides switch sub 100, perforating guns 300A, 300B, and direct connect sub 500.

In this embodiment, switch sub 100 generally includes an outer housing 102, an electronic first or gun switch 120, a multi-contact bulkhead connector 160, and a second or single-contact bulkhead connector 220. Housing 102 of switch sub 100 has a first or upper end 104, a second or lower end 106, a central bore or passage defined by a generally cylindrical inner surface 108 extending between ends 104, 106, and a generally cylindrical outer surface 110 extending between ends 104, 106. The central passage of housing 102 includes a switch receptacle 112, an upper bulkhead receptacle 114 extending between upper end 104 and switch receptacle 112, and a lower bulkhead receptacle 116 extending between switch receptacle 112 and the lower end 106 of housing 102. An annular first or upper shoulder 113 of the inner surface 108 separates upper bulkhead receptacle 114 and switch receptacle 112 while an annular second or lower shoulder 115 of inner surface 108 separates lower bulkhead receptacle 116 from switch receptacle 112. Gun switch 120 is disposed in switch receptacle 112, multi-contact bulkhead connector 160 is disposed in upper bulkhead receptacle 114, and single-contact bulkhead connector 220 is disposed in lower bulkhead receptacle 116. In this embodiment, the outer surface 110 includes a pair of annular first or upper seal assemblies 117A positioned thereon, a pair of annular second or lower seal assemblies 117B positioned thereon, and a pair of releasable or threaded connectors 118 formed thereon and positioned at the ends 104, 106 of housing 102.

Referring to FIGS. 3, 6A-7B, an embodiment of gun switch 120 of switch sub 100 is shown in FIGS. 6A-7B. Gun switch 120 has a central or longitudinal axis 125 (shown in FIG. 6A), an axial maximum length 120L (extending along central axis 125), and a maximum diameter 120D (extending orthogonal central axis 125). In the embodiment of FIGS. 3, 6A-7B, gun switch 120 generally includes a printed circuit board (PCB) 122 having an electrical circuit 124 (shown schematically in FIG. 6A) including electronic components positioned thereon. In this embodiment, the electronic components of electrical circuit 124 generally include a processor and a memory, such as a reprogrammable memory; however, in other embodiments, the electronic components of electrical circuit 124 may vary. PCB 122 and electrical circuit 124 are centrally positioned in a housing or potting compound 126 (shown as transparent in FIG. 6A for clarity) having a cylindrical outer surface 128. Potting compound 126 comprises a solid or gelatinous material configured to provide electrical insulation and resistance to shock and/or vibration at elevated temperatures (e.g., 300-350 degrees Fahrenheit or greater) to thereby protect electrical circuit 124. In some embodiments, potting compound 126 comprises an epoxy resin; however, in other embodiments, the material from which potting compound 126 is comprised may vary.

In this embodiment, the electrical circuit 124 positioned on the PCB 122 of gun switch 120 includes a first or upper electrical connector 130, a second or lower electrical connector 140, and a pair of circumferentially spaced radial ground contacts 150. As shown particularly in FIG. 6A, contacts 130, 140 each extend along central axis 125 while ground contacts 150 are spaced from central axis 125 and extend radially outwards therefrom. As shown particularly in FIG. 6C, upper electrical connector 130 comprises a wireline circuit or female contact 132 and a pair of detonator circuits or female contacts 134. Thus, in this embodiment, upper electrical connector 130 comprises a multi-contact connector. As shown particularly in FIG. 6D, lower electrical connecter 140 comprises a single wireline circuit or female contact 142. The wireline contacts 132, 142 of electrical connectors 130, 140 allow for electrical signals and/or data to be selectably communicated from wireline 22 to components of tool string 20 positioned downhole of switch sub 100 (e.g., lower perforating gun 300B, plug-shoot firing head 600, etc.).

The detonator contacts 134 of upper electrical connector 130 allow for electrical signals to be selectably communicated between wireline 22 and a detonator of upper perforating gun 300A, as will be described further herein. Ground contacts 150 extend radially outwards from the outer surface 128 of potting compound 126 and are configured to contact inner surface 108 of the switch receptacle 112 of housing 102 to thereby ground the electrical circuit 124 of gun switch 120 to housing 102. In some embodiments, each ground contact 150 comprises a biasing member configured to bias ground contacts 150 into engagement with the inner surface 108 of housing 102, thereby maintaining contact between ground contacts 150 and housing 102 during operation of tool string 20.

Figure 3:
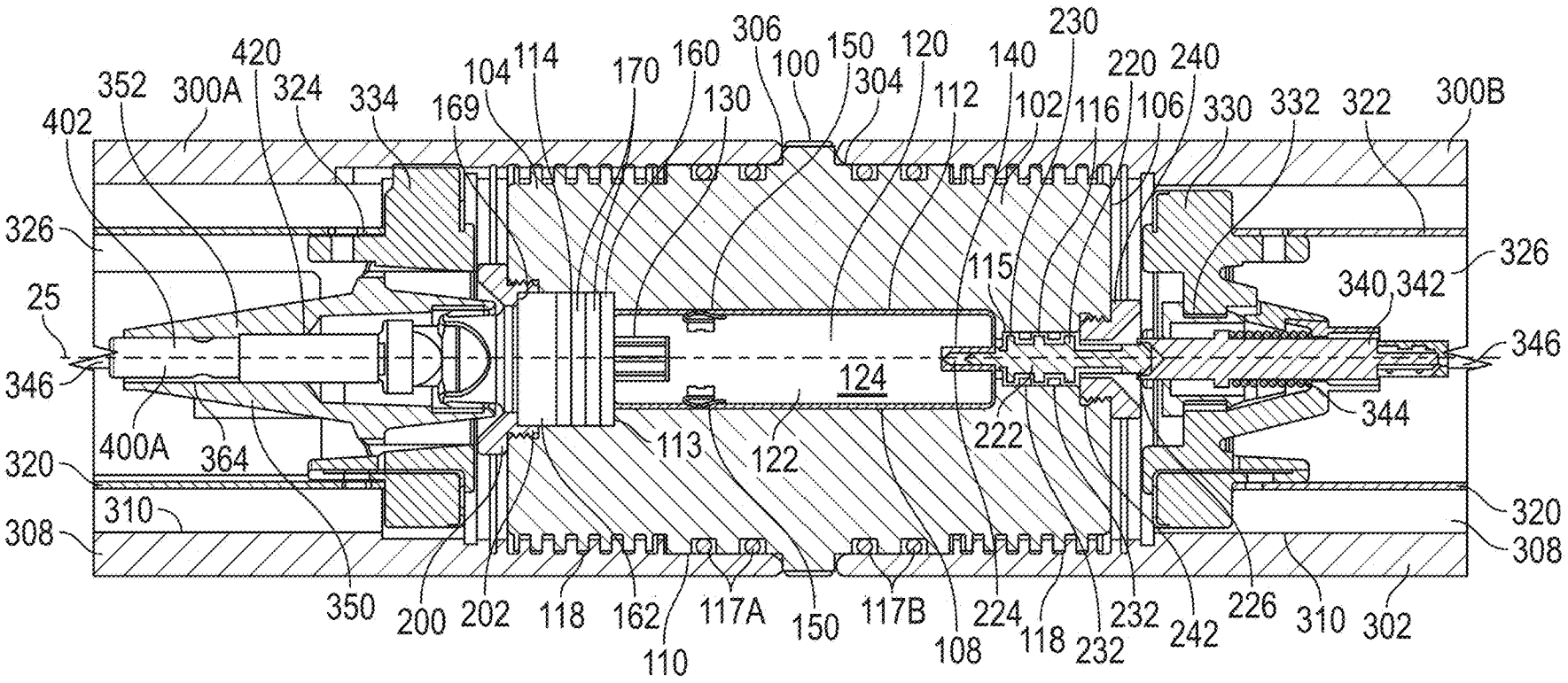
FIG. 3 is a cross-sectional view along line 3-3 of FIG. 2 of the switch sub of FIG. 2.
Figure 8A:
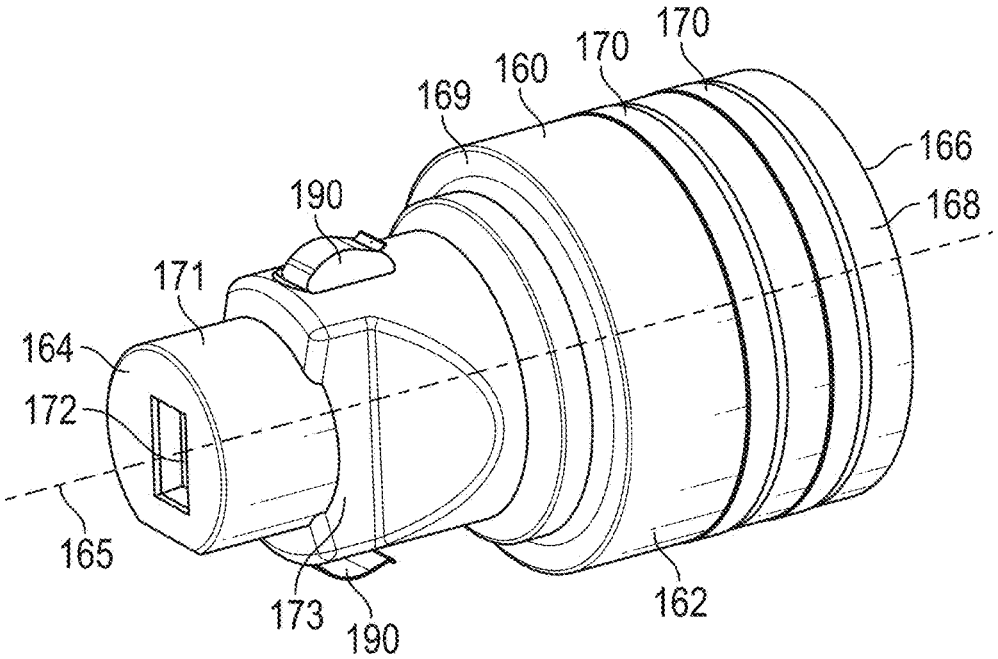
FIGS. 8A, 8B are perspective views of an embodiment of a multi-contact bulkhead connector of the switch sub of FIG. 2 in accordance with principles disclosed herein.
Figure 8B:
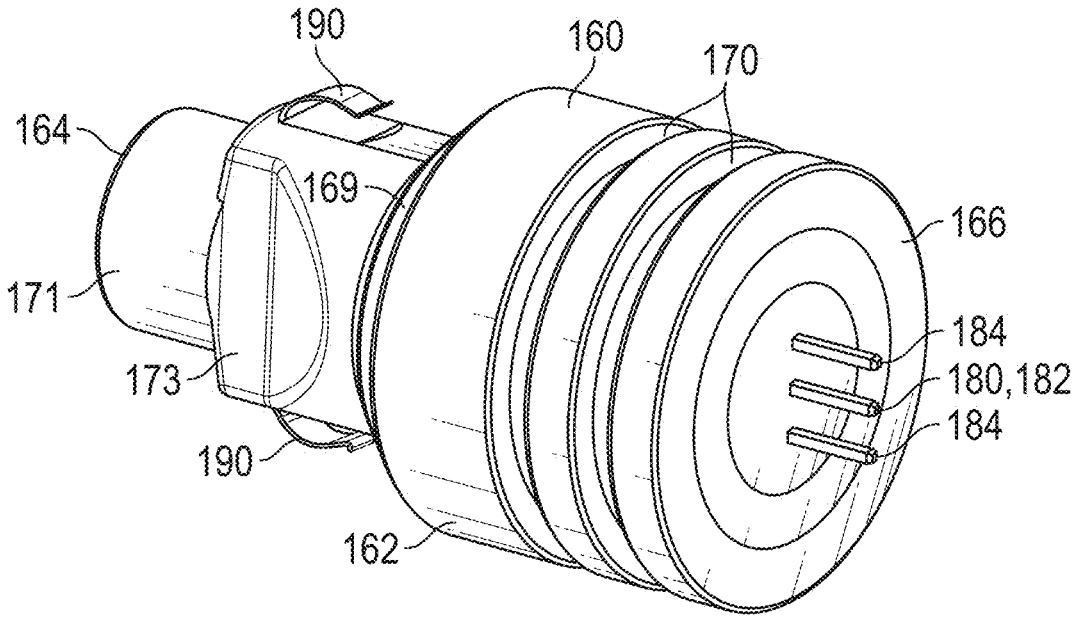
Figure 9A:
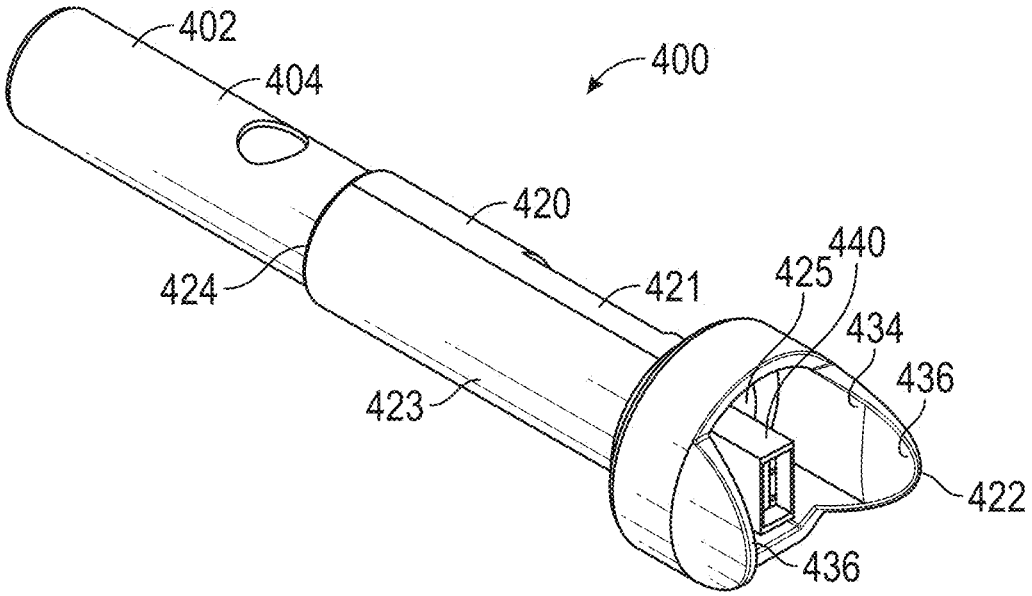
FIG. 9A is a perspective view of an embodiment of a detonator assembly of the tool string of FIG. 1 in accordance with principles disclosed herein.
Figure 9B:
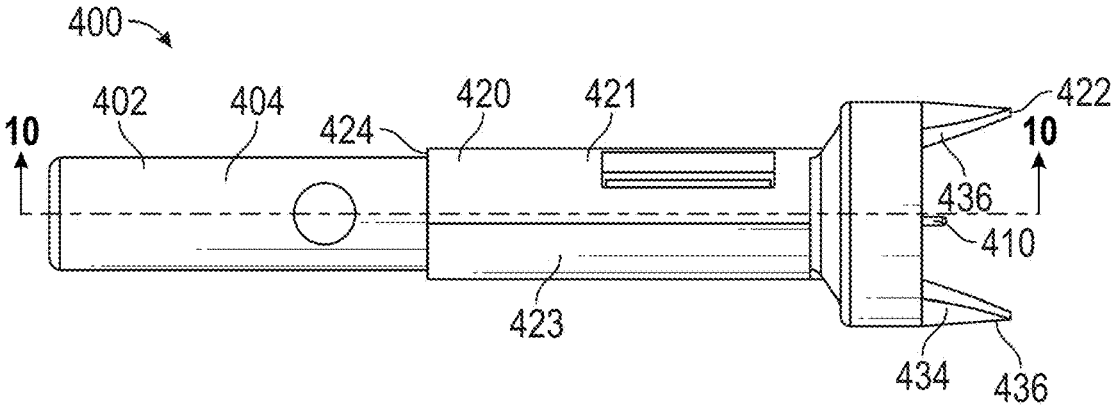
FIG. 9B is a side view of the detonator assembly of FIG. 9A.
Figure 9C:
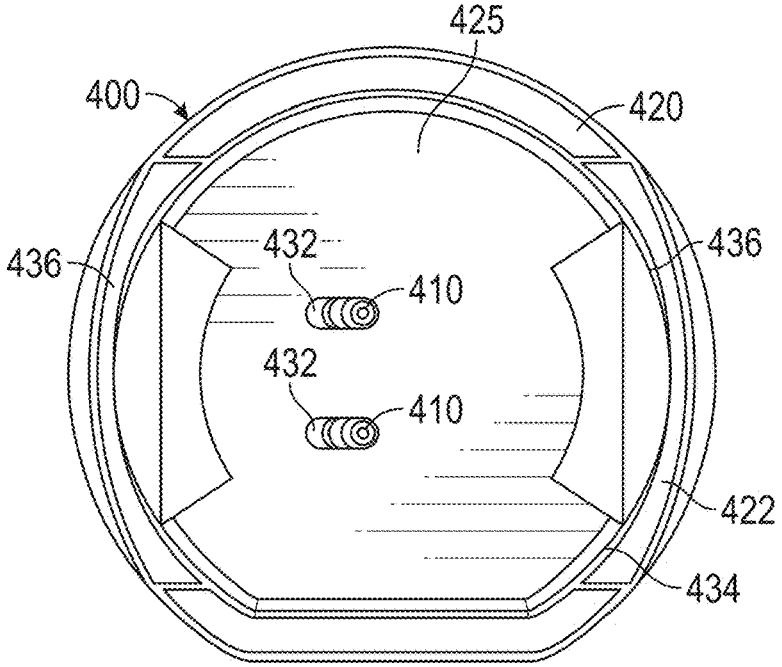
FIG. 9C is a front view of the detonator assembly of FIG. 9A.
Figure 10:
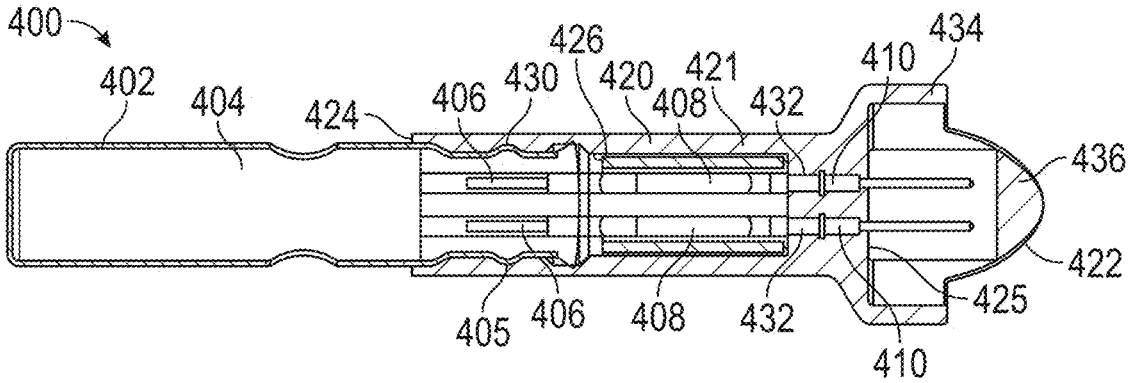
FIG. 10 is a cross-sectional view along line 10-10 of FIG. 9B of the detonator assembly of FIG. 9A.
Figure 11:
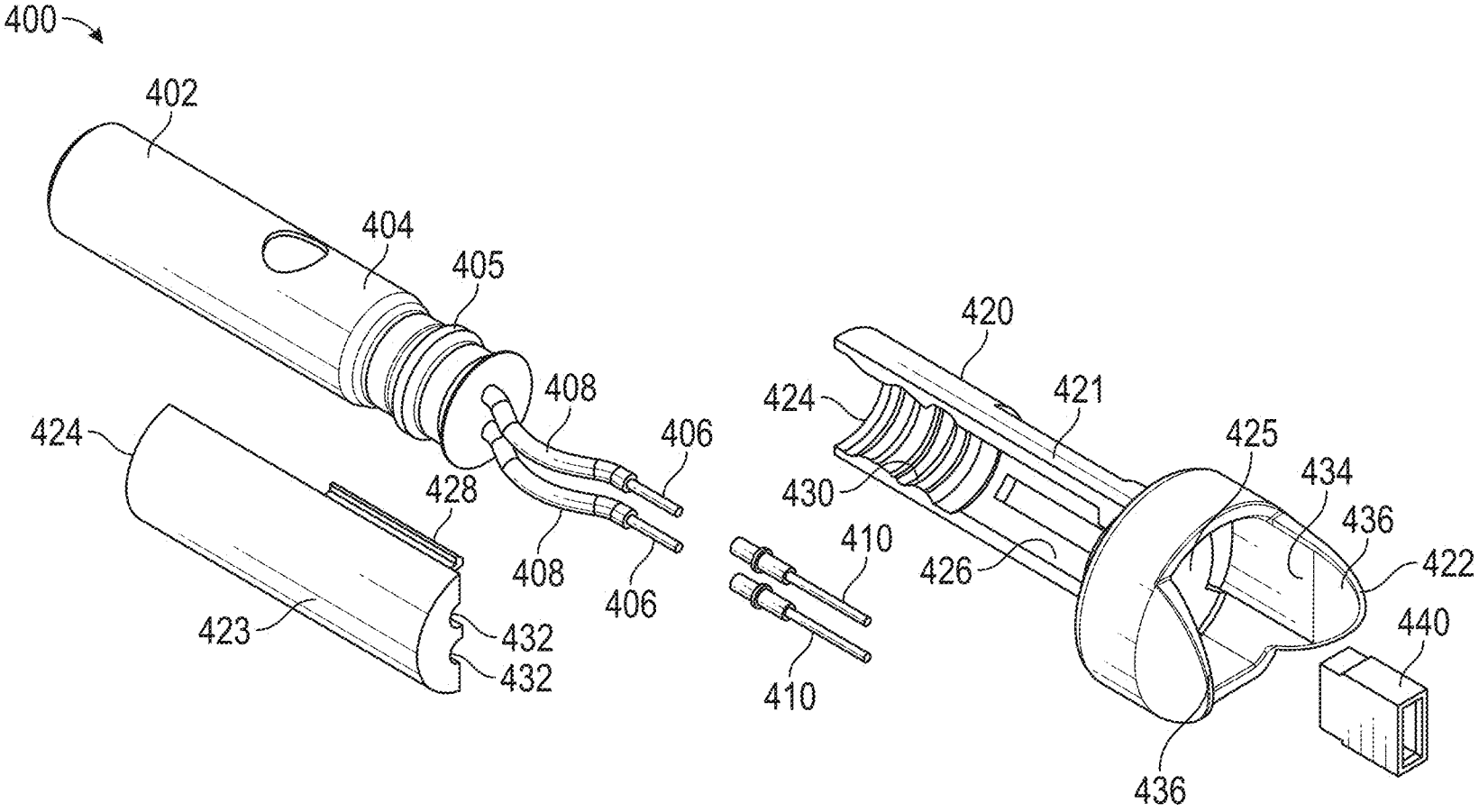
FIG. 11 is an exploded view of the detonator assembly of FIG. 9A.

Referring to FIGS. 3, 8A, and 8B, an embodiment of the multi-contact bulkhead connector 160 of switch sub 100 is shown in FIGS. 8A, 8B. In the embodiment of FIGS. 3, 8A, 8B, multi-contact bulkhead connector 160 has a central or longitudinal axis 165 (shown in FIG. 8A) and generally includes a housing 162 and a PCB (not shown in FIGS. 8A, 8B) housed therein. Housing 162 has a first or upper end 164, a second or lower end 166, and a generally cylindrical outer surface 168 extending between ends 164, 166. In this embodiment, the outer surface 168 of housing 162 includes an annular shoulder 169 and a pair of annular seal assemblies 170. Seal assemblies 170 are configured to sealingly engage the inner surface 108 of the upper bulkhead receptacle 114 of housing 102 when multi-contact bulkhead connector 160 is positioned therein, thereby restricting fluid communication between upper bulkhead receptacle 114 and the switch receptacle 112 of housing 102.

Additionally, multi-contact bulkhead connector 160 is configured to act as a pressure bulkhead isolating switch 120 from pressure in upper perforating gun 300A (due to the firing of gun 300A, for example) and/or pressure in the environment surrounding switch sub 100. In other words, multi-contact bulkhead connector 160 is configured to restrict the communication of fluid pressure between upper end 164 and lower end 166. The outer surface 168 of multi-contact bulkhead connector 160 comprises an annular engagement surface 171 extending from upper end 164 and a pair of opposing flanking engagement surface 173 extending from annular engagement surface 171. In this embodiment, annular engagement surface 171 comprises a planar surface extending between opposing ends of an arcuate surface of annular engagement surface 171. Additionally, in this embodiment, flanking engagement surfaces 173 are circumferentially spaced approximately 180 degrees about a longitudinal axis of multi-contact bulkhead connector 160.

The PCB of multi-contact bulkhead connector 160 includes an electrical circuit that comprises electronic components including a first or upper electrical connector 172, a second or lower electrical connector 180 in signal communication with upper electrical connector 172, and a pair of circumferentially spaced radial circuits or contacts 190 in signal communication with lower electrical connector 180. Connectors 172, 180 each extend along central axis 165 while radial contacts 190 are spaced from central axis 165 and extend radially outwards therefrom. In this embodiment, upper electrical connector 172 comprises a pair of detonator circuits or female contacts. Lower electrical connector 180 comprises a wireline circuit or male contact 182 and a pair of detonator circuits or male contacts 184. Radial contacts 190 are electrically connected to the wireline contact 182 of lower electrical connector 180, thereby permitting signals and/or data to be transmitted from wireline 22 to the electrical circuit 124 of switch sub 100 via the insertion of the wireline contact 182 of lower electrical connector 180 into the wireline contact 132 of the upper electrical connector 130 of switch 120.

In this embodiment, the PCB of multi-contact bulkhead connector 160 does not include transistors, resistors, or other electronic components beyond electrical connectors 172, 180, 190, and the electrical conductors extending therebetween; however, in other embodiments, the PCB of multi-contact bulkhead connector 160 may include additional electronic components. Additionally, in this embodiment, housing 162 is overmolded to the previously formed PCB to form multi-contact bulkhead connector 160, where housing 162 comprises one of Polyether ether ketone (PEEK), Ultem, or a similar material; however, in other embodiments, the material from which housing 162 is comprised may vary. In some embodiments, housing 162 may comprise one or more strengthening materials, such as glass.

Additionally, the detonator contacts of upper electrical connector 172 are electrically connected to detonator contacts 184 of lower electrical connector 180. In this configuration, electrical signals may be selectably communicated between the detonator of upper perforating gun 300A and electrical circuit 124 of switch 120 via the insertion of the detonator contacts 184 of lower electrical connector 180 into the detonator contacts 134 of the upper electrical connector 130 of switch 120. In this embodiment, switch sub 100 includes an annular fist or upper retainer 200 (shown in FIG. 3) having an outer surface that includes a releasable or threaded connector 202 which releasably or threadably connects to a corresponding threaded connector formed on the inner surface 108 of upper bulkhead receptacle 114 to couple upper retainer 200 to housing 102. Additionally, an inner surface of upper retainer 200 includes an annular shoulder that matingly engages the annular shoulder 169 of multi-contact bulkhead connector 160 to thereby retain upper bulkhead connector 160 within upper bulkhead receptacle 114 and limit relative axial movement between multi-contact bulkhead connector 160 and housing 102. In this embodiment, force applied to upper bulkhead connector 160 due to pressure applied to the upper end 164 of upper bulkhead connector 160 is transferred to housing 102 via contact between the lower end 166 of upper bulkhead connector 160 and the upper shoulder 113 of housing 102, thereby restricting pressure applied to upper end 164 of upper bulkhead connector 160 from being communicated to switch 120.

As shown particularly in FIG. 3, the single-contact bulkhead connector 220 generally includes a generally cylindrical electrical conductor 222 including a first or upper male contact 224, and a second or lower male contact 226. Upper male contact 224 of electrical conductor 222 is insertable into the female contact 142 of the lower electrical connector 140 of switch 120 to provide an electrical connection between the electrical circuit 124 of switch 120 and single-contact bulkhead connector 220. Additionally, single-contact bulkhead connector 220 includes an insulation sleeve 230 surrounding conductor 222, and a pair of annular seal assemblies 232 surrounding insulation sleeve 230. Insulation sleeve 230 electrically insulates electrical conductor 222 from housing 102 while seal assemblies 232 restrict fluid communication between lower bulkhead receptacle 116 and switch receptacle 112.

Additionally, single-contact bulkhead connector 220 is configured to act as a pressure bulkhead isolating switch 120 from pressure in lower perforating gun 300B (due to the firing of gun 300B, for example) and/or pressure in the environment surrounding switch sub 100. In this embodiment, switch sub 100 includes an annular second or lower retainer 240 having an outer surface that includes a releasable or threaded connector 242 which releasably or threadably connects to a corresponding threaded connector formed on the inner surface 108 of lower bulkhead receptacle 116 to couple lower retainer 240 to housing 102. Additionally, an inner surface of lower retainer 240 includes an annular shoulder that matingly engages an annular shoulder formed on the outer surface of the insulation sleeve 230 of single-contact bulkhead connector 220 to thereby retain lower bulkhead 220 within lower bulkhead receptacle 116 and limit relative axial movement between single-contact bulkhead connector 220 and housing 102. In this embodiment, force applied to single-contact bulkhead connector 220 due to pressure applied to a lower end of bulkhead connector 220 is transferred to housing 102 via contact between an upper end of bulkhead connector 220 and the lower shoulder 115 of housing 102, thereby restricting pressure applied to the lower end of bulkhead connector 220 from being communicated to switch 120.

Referring again to FIGS. 2-5, embodiments of perforating guns 300A, 300B of the tool string 20 are shown therein. Each perforating gun 300A, 300B generally includes an outer housing 302, and a charge tube 320 positioned therein. The housing 302 of each perforating gun 300A, 300B has a first or upper end 304, a second or lower end 306, and a central bore or passage 308 defined by a generally cylindrical inner surface 310 that extends between ends 304, 306. In the embodiment of FIGS. 2-5, a generally cylindrical outer surface of housing 302 includes a plurality of indentations or scallops 312 configured to fracture or break-apart during the firing of perforating guns 300A, 300B; however, in other embodiments, housing 302 may not include scallops 312. In this configuration, an upper threaded connector 118 of the housing 102 of switch sub 100 releasably or threadably connects to a threaded connector formed on the inner surface 310 of the lower end 306 of upper perforating gun 300A, and a lower threaded connector 118 of the housing 102 of switch sub 100 releasably or threadably connects to a threaded connector formed on the inner surface 310 of the upper end 304 of lower perforating gun 300B. Additionally, upper seal assemblies 117A of the housing 102 of switch sub 100 sealingly engage the inner surface 310 of the housing 302 of upper perforating gun 300A while lower seal assemblies 117B of the housing 102 of switch sub 100 sealingly engage the inner surface 310 of the housing 302 of lower perforating gun 300B.

The charge tube 320 of each perforating gun 300A, 300B is generally cylindrical and has a first or upper end 322, a second or lower end 324, and a central bore or passage 326 extending between ends 322, 324. As will be described further herein, charge tube 320 is configured to receive a plurality of explosive perforating or shaped charges (not shown in FIGS. 2-5) positioned in openings formed in charge tube 320. The shaped charges are configured to fire in response to the actuation of a detonator assembly 400, each shaped charge being axially and circumferentially aligned with one of the scallops 312 of housing 302. For convenience, in FIGS. 3-5 the detonator assemblies 400 of tool string 20 are shown as a first or upper detonator assembly 400A and a second or lower detonator assembly 400B; however, in this embodiment, the detonator assemblies 400 of tool string 20 are each similarly configured. Additionally, a first or upper charge tube endplate 330 is coupled to the upper end 322 of each charge tube 320 and a second or lower charge tube endplate 334 is coupled to the lower end 324 of each charge tube 320. In this embodiment, each endplate 330, 334 generally comprises a nonmetallic, non-electrically conductive material (e.g., a plastic, etc.).

In this embodiment, upper endplate 330 of each perforating gun 300A, 300B includes a central bore or passage 332 that receives a first or upper electrical connector 340 that includes a generally cylindrical electrical conductor 342 and a biasing member 344 that biases electrical conductor 342 towards the single-contact bulkhead connector 220 of switch sub 100. Particularly, biasing member 344 acts against an annular shoulder of electrical conductor 342 to maintain contact between an upper end of electrical conductor 342 and a lower end 226 of the electrical conductor 222 of single-contact bulkhead connector 220, thereby providing an electrical connection between the upper electrical connector 340 of lower perforating gun 300B and the single-contact bulkhead connector 220 of switch sub 200. Additionally, a lower end of electrical conductor 342 is connected to a signal conductor or charge tube cable 346 that extends between an upper end and a lower end of the charge tube 320 of lower perforating gun 300B. In this configuration, signals and/or data may be selectably communicated from wireline 22 to charge tube cable 346 (and components of tool string 20 positioned downhole of lower perforating gun 300B) via the electrical connection formed between single-contact bulkhead connector 220 of switch sub 100 and the upper electrical connector 340 of lower perforating gun 300B.

In this embodiment, lower endplate 334 of each perforating gun 300A, 300B includes a central bore or passage that receives a second or lower electrical connector 350. Referring to FIGS. 3, 5, and 13A-15D, the lower electrical connector 350 of each perforating gun 300A, 300B is shown in detail in FIGS. 13A-15D. In the embodiment of FIGS. 3, 5, and 13A-15D, lower electrical connector 350 includes a housing 352 (shown semi-transparently in FIGS. 13A, 13B for clarity) and an electrical conductor 380 disposed within housing 352. In this embodiment, housing 352 generally comprises a nonmetallic, non-electrically conductive material (e.g., a plastic, etc.); however, in other embodiments, the material from which housing 352 is comprised may vary. Housing 352 has a first or upper end 354, a second or lower end 356, a central bore or passage 358 extending between ends 354, 356, and an outer surface 360 extending between ends 354, 356. In this embodiment, the electrical conductor 380 of lower electrical connector 350 is overmolded to form housing 352, where housing 352 comprises one of Polyether ether ketone (PEEK), Ultem, Nylon, or a similar material; however, in other embodiments, the material from which housing 352 is comprised may vary. In some embodiments, housing 352 of lower electrical connector 350 may comprise one or more strengthening materials, such as glass.

In this embodiment, the outer surface 360 of housing 352 includes a plurality of circumferentially spaced flexible or snap connectors 362 positioned proximal to the lower end 356 of housing 352. Snap connectors 362 are configured to connect housing 352 to an inner surface of the lower endplate 334 of charge tube 320. At least a portion of the central passage 358 of housing 352 forms a detonator receptacle 364 extending from the upper end 354 of housing 352, wherein detonator receptacle 364 extends along central axis 355. As will be described further herein, detonator receptacle 364 is configured to receive one of the detonator assemblies 400A, 400B and permit relative rotation between lower electrical connector 350 and detonator assembly 400A, 400B when detonator assembly 400A, 400B is received in detonator receptacle 364.

Additionally, housing 352 includes a detonator cord or "detcord" receptacle 366 that also extends into the lower end 366 of housing 352 in a direction parallel with, but radially offset from, central axis 355. Detcord receptacle 366 is configured to receive an end of a detonator cord or detcord connected to the shaped charges of charge tube 320. Additionally, detcord receptacle 366, being positioned adjacent detonator receptacle 364, is configured to position the end of the detcord adjacent one of the detonator assemblies 400A, 400B such that the detonator assembly 400A, 400B may selectably initiate or ignite the detcord and thereby fire the shaped charges coupled to charge tube 320. Housing 352 further includes an electrical stab connector 368 positioned adjacent upper end 354. Stab connector 368 includes a receptacle 370 extending into housing 352 in a direction parallel with, but radially offset from, central axis 355. Stab connector 368 additionally includes a protrusion 372 formed on outer surface 360 of housing 352.

Figure 14:
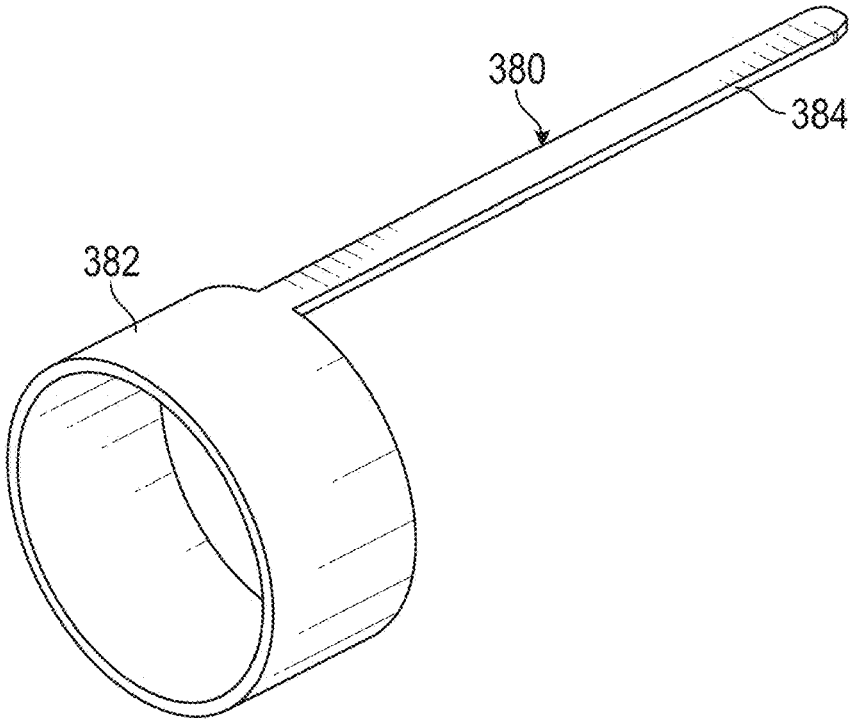
FIG. 14 is a perspective view of an embodiment of an electrical conductor of the electrical connector of FIGS. 13A-13C in accordance with principles disclosed herein.
Figure 15A:
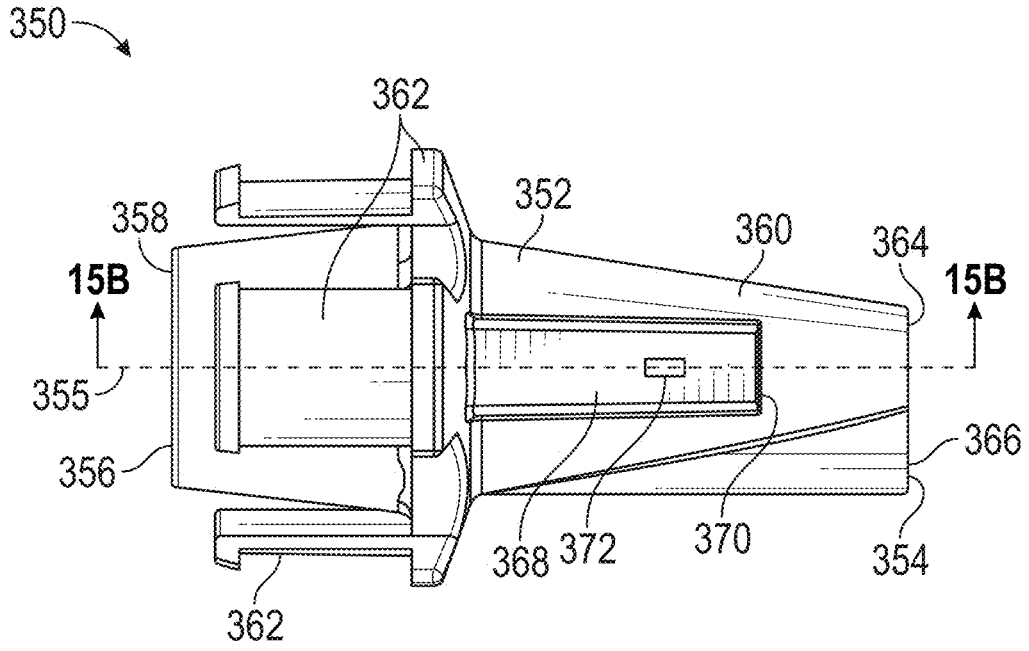
FIG. 15A is a side view of the electrical connector of FIGS. 13A-13C.
Figure 15B:
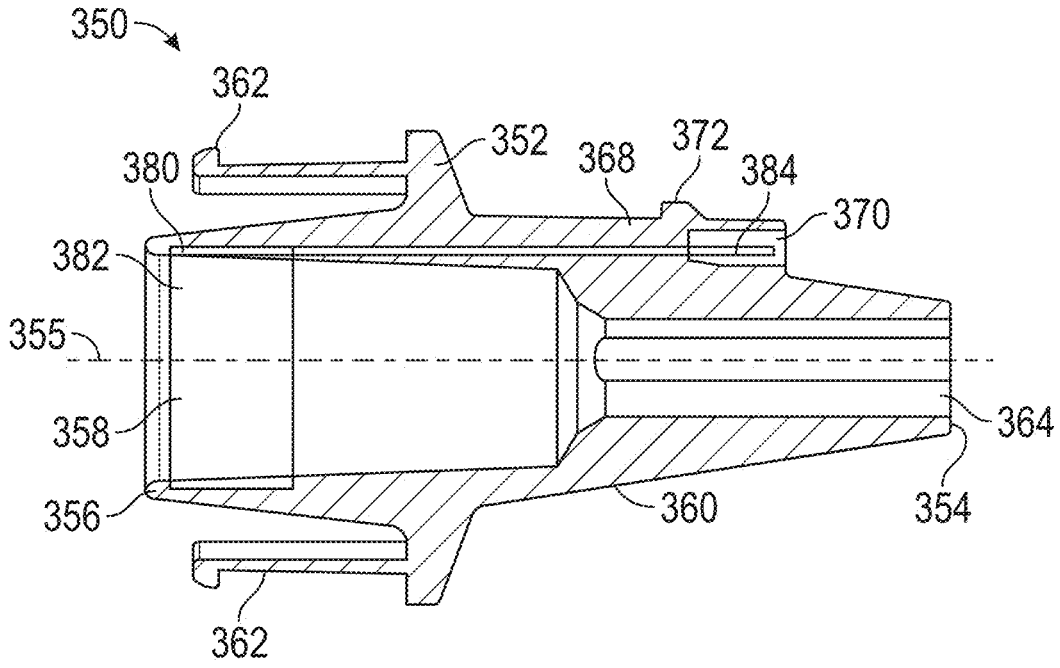
FIG. 15B is a cross-sectional view along line 15B-15B of FIG. 15A of the electrical connector of FIGS. 13A-13C.
Figure 15C:
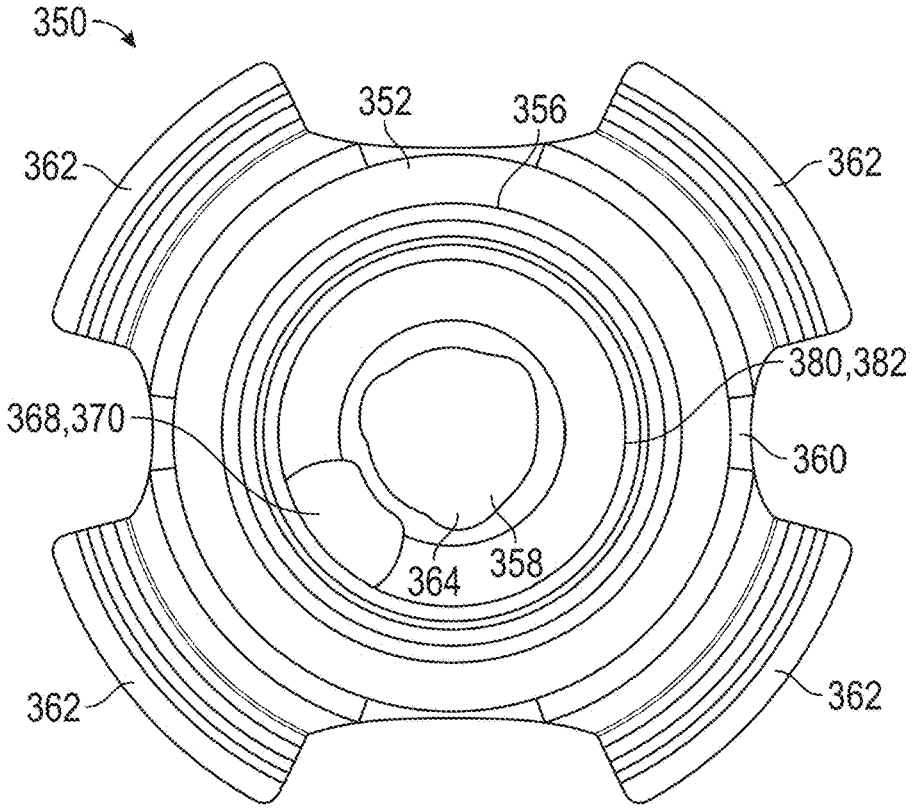
FIG. 15C is a front view of the electrical connector of FIGS. 13A-13C.
Figure 15D:
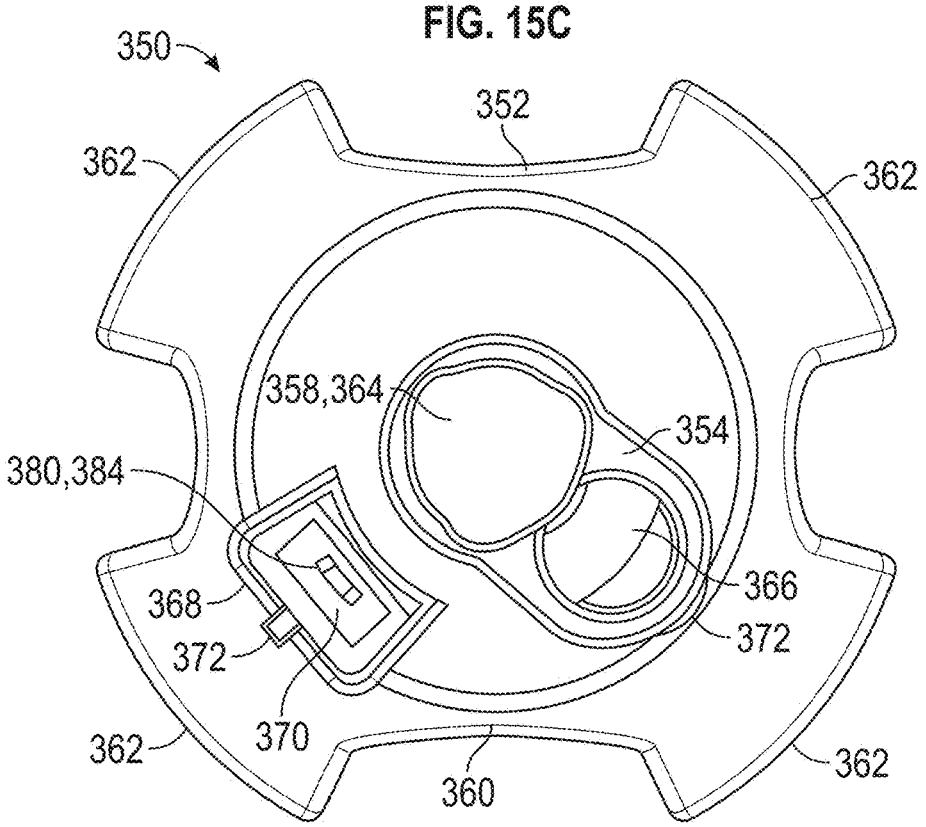
FIG. 15D is a rear view of the electrical connector of FIGS. 13A-13C.
Figure 16A:
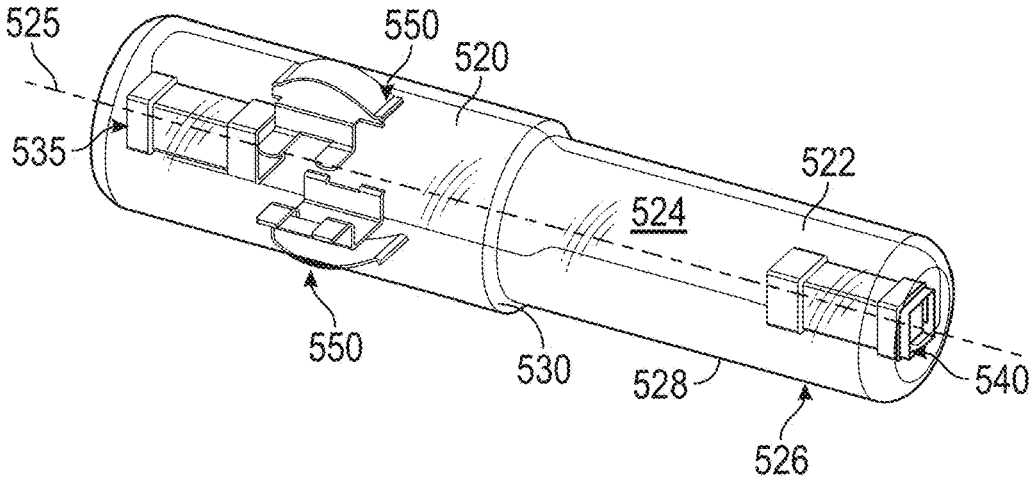
FIG. 16A is a perspective view of an embodiment of a second switch of the direct connect sub of FIG. 2 in accordance with principles disclosed herein.
Figure 16B:
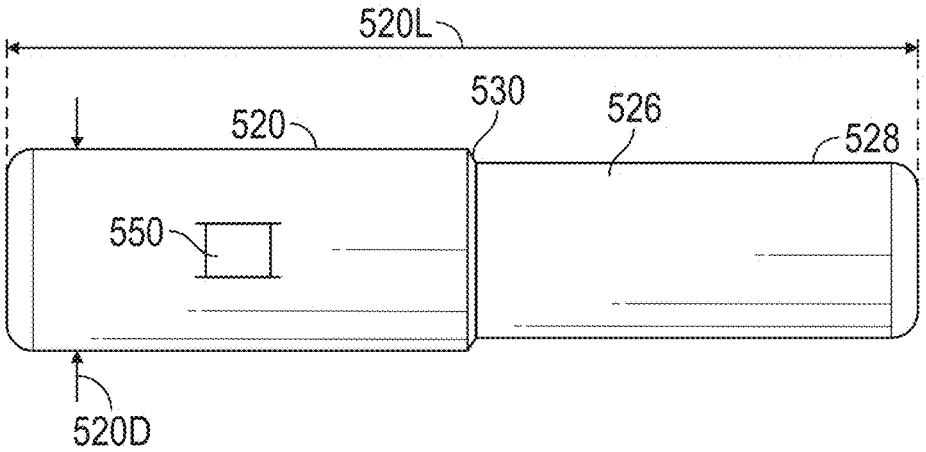
FIG. 16B is a side view of the second switch of FIG. 16A.
Figure 16C:
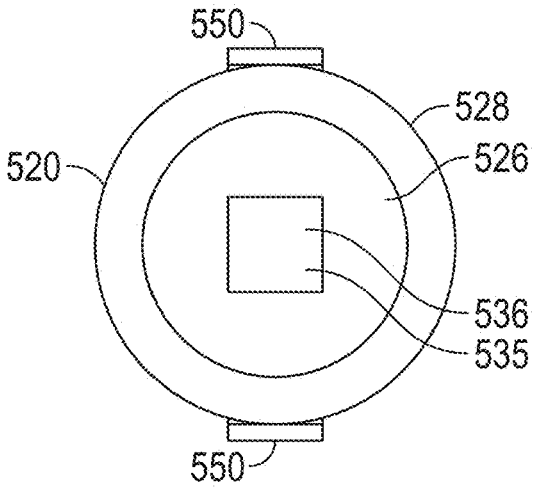
FIG. 16C is a front view of the second switch of FIG. 16A.
Figure 16D:
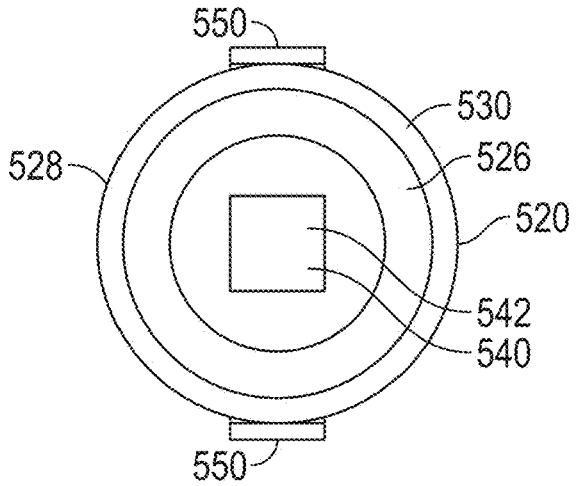
FIG. 16D is a rear view of the second switch of FIG. 16A.
Figure 17A:
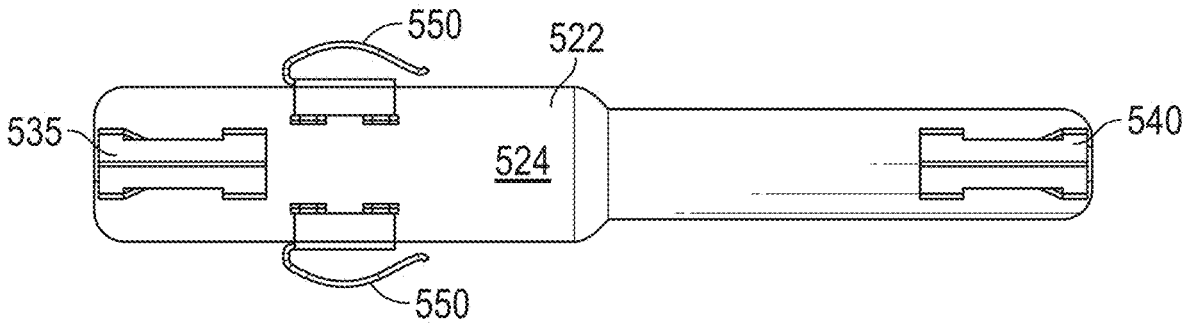
FIG. 17A is a top view of an embodiment of a printed circuit board (PCB) of the second switch of FIG. 16A in accordance with principles disclosed herein.
Figure 17B:
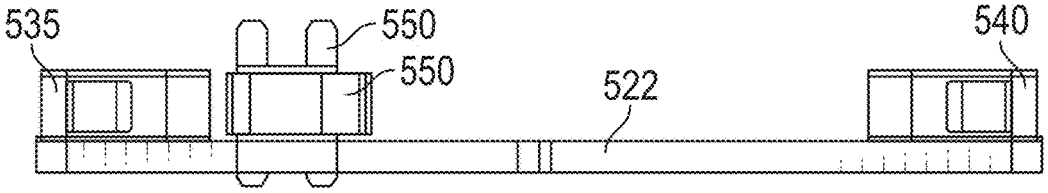
FIG. 17B is a side view of the PCB of FIG. 17A.
Figure 18A:
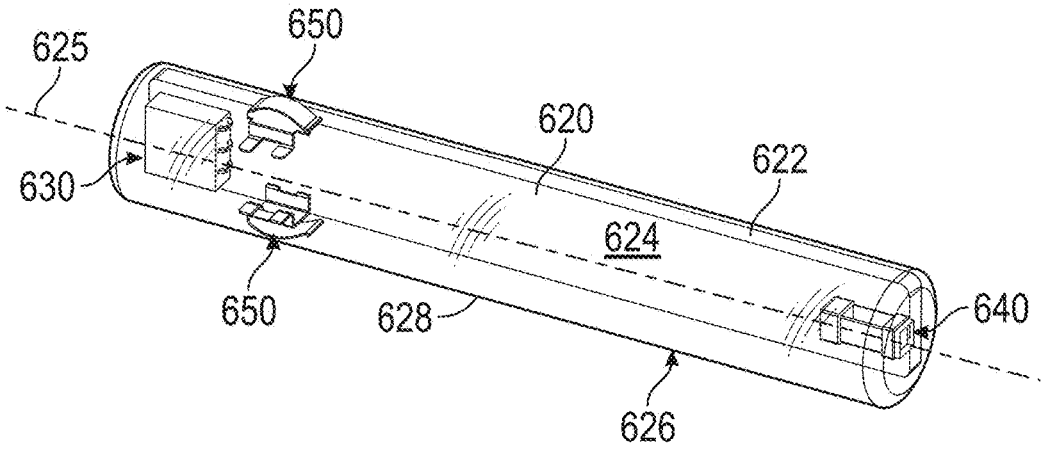
FIG. 18A is a perspective view of an embodiment of a third switch of the plug-shoot firing head of FIG. 2 in accordance with principles disclosed herein.
Figure 18B:
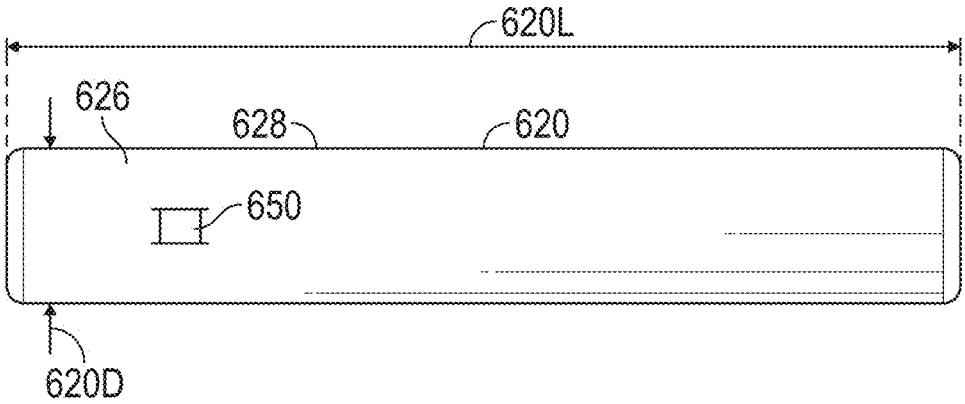
FIG. 18B is a side view of the third switch of FIG. 18A.
Figure 18C:
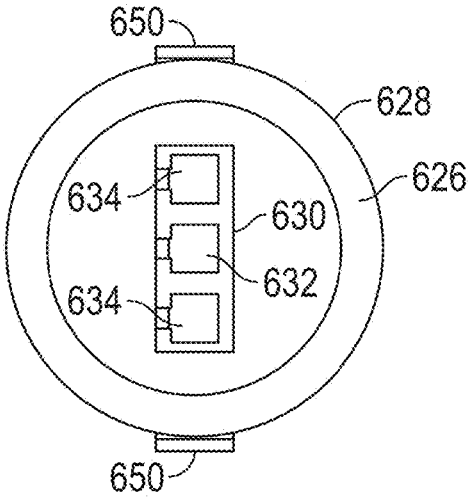
FIG. 18C is a front view of the third switch of FIG. 18A.
Figure 18D:
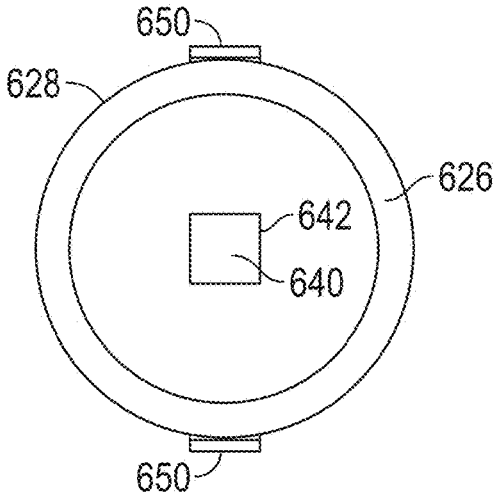
FIG. 18D is a rear view of the third switch of FIG. 18A.
Figure 19A:
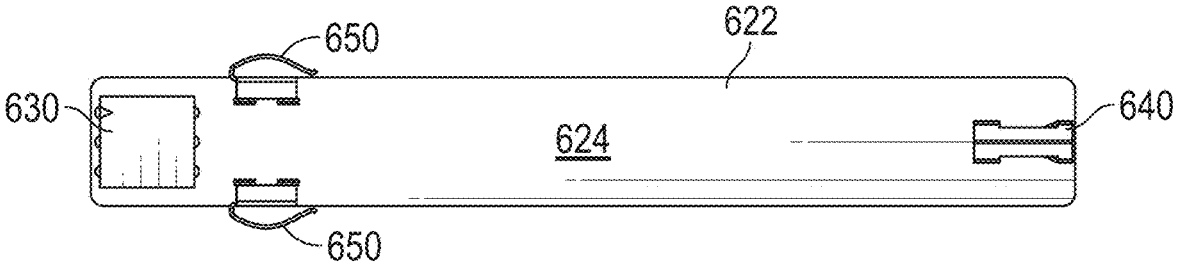
FIG. 19A is a top view of an embodiment of a printed circuit board (PCB) of the third switch of FIG. 18A in accordance with principles disclosed herein.
Figure 19B:
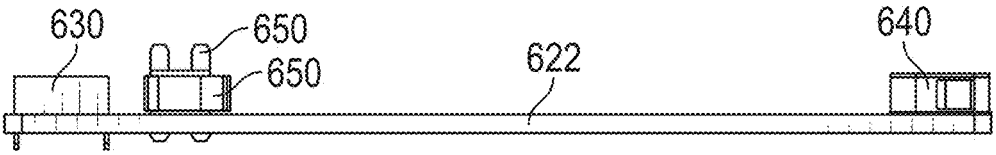
FIG. 19B is a side view of the PCB of FIG. 19A.
Figure 20:
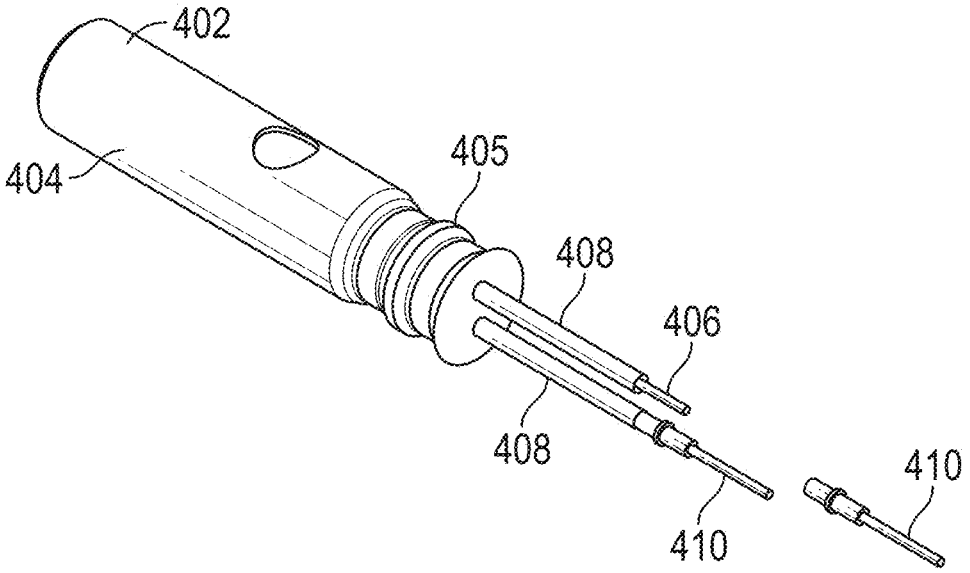
FIGS. 20-23 are perspective views showing an embodiment of a method for assembling the detonator assembly of FIG. 9A.

As shown particularly in FIG. 14, in this embodiment, the electrical conductor 380 of lower electrical connector 350 includes an annular or ring-shaped contact 382 and an elongate contact 384 extending therefrom. Annular contact 382 is positioned proximal the lower end 356 of housing 352, and an inner surface of annular contact 382 is exposed to the central passage 358 of housing 352. Elongate contact 384 extends at least partially through the receptacle of the stab connector 368 of housing 352. In this configuration, the charge tube cable 346 includes an electrical connector that contacts the elongate contact 384 to provide an electrical connection between the electrical conductor 380 of lower electrical connector 350 and charge tube cable 346, where the connector of charge tube cable 346 is secured to lower electrical connector 350 via the protrusion 372 of housing 352. Additionally, annular contact 382 of electrical conductor 380 contacts the radial contacts 190 of multi-contact bulkhead connector 160, thereby providing an electrical connection between the electrical conductor 380 of lower electrical connector 350 and the electrical circuit of multi-contact bulkhead connector 160 such that signals and/or data from wireline 22 may be selectably communicated between lower electrical connector 350 and multi-contact bulkhead connector 160 while also permitting relative rotation between lower electrical connector 350 and multi-contact bulkhead connector 160.

Referring to FIGS. 3, 9A-11, an embodiment of a detonator assembly 400 is shown in detail in FIGS. 9A-11. The detonator assemblies 400A, 400B shown in FIGS. 2-5 are configured similarly as the detonator assembly 400 shown in FIGS. 9A-11. In the embodiment of FIGS. 3, 9A-11, detonator assembly 400 includes a detonator 402 and a connector housing 420 coupled to detonator 402. Detonator 402 of detonator assembly 400 includes a detonator housing 404, one or more explosive or flammable materials (not shown in FIGS. 3, 9A-11) housed within detonator housing 404, and a pair of electrical conductors or wires 406 extending therefrom. Detonator 402 is generally configured to produce a thermal reaction igniting the detcord of charge tube 320 in response to the passage of an electrical signal through wires 406. An outer surface of detonator housing 404 includes an annular ridge or shoulder 405 formed thereon. In this embodiment, wires 406 are at least partially sheathed by electrical insulators 408. Additionally, detonator 402 includes a pair of electrical terminals or contacts 410, where each male terminal 410 is connected to a terminal end of a corresponding wire 406.

The connector housing 420 of detonator assembly 400 has a first end 422, a second end 424 opposite first end 422, and a central bore or passage defined by a generally cylindrical inner surface 426 extending between second end 424 and a base 425. Additionally, connector housing 420 comprises separate, connectable components to assist with assembling connector housing 420 with detonator 402. In this embodiment, connector housing 420 comprises a first arcuate portion 421 and a second arcuate portion 423. A flexible snap connector 428 formed along an edge of second arcuate portion 423 may be matingly inserted into a corresponding groove formed in first arcuate portion 421 to couple arcuate portions 421, 423 together. When arcuate portions 421, 423 of connector housing 420 are in an assembled configuration, inner surface 426 of connector housing 420 forms an annular groove 430 in which the annular shoulder 405 of detonator housing 404 may be received to restrict relative axial movement between connector housing 420 and detonator 402 when detonator assembly 400 is in an assembled configuration.

In this embodiment, connector housing 420 includes a pair of apertures 432 that extend through base 425 and are configured to allow for the passage of terminals 410 of detonator 402 therethrough. Terminals 410 of detonator assembly 400 may be inserted into the female contacts of the upper electrical connector 172 of multi-contact bulkhead connector 160 to provide an electrical connection therebetween. In this manner, an activation or firing signal may be selectably transmitted from the electrical circuit 124 of switch 120 to the detonator 402 of detonator assembly 400.

In this embodiment, connector housing 420 includes a flexible or snap connector 434 extending from base 425 and configured to matingly engage the engagement surfaces 171, 173 of multi-contact bulkhead connector 160. Particularly, snap connector 434 includes a pair of circumferentially spaced arms 436 configured to matingly engage the flanking engagement surfaces 173 of multi-contact bulkhead connector 160. Arms 436 permit snap connector 434 to latch to multi-contact bulkhead connector 160, inhibiting or preventing disconnection of snap connector 434 from bulkhead connector 160 while also restricting relative rotation between connector housing 420 and bulkhead connector 160.

Mating engagement between arms 436 of connector housing 420 with flanking engagement surfaces 173 of multi-contact bulkhead connector 160 assists with angularly aligning detonator assembly 400 with multi-contact bulkhead connector 160 such that terminals 410 of detonator assembly 400 may be axially inserted into the corresponding female contacts of the upper electrical connector 172 of multi-contact bulkhead connector 160, thereby providing an electrical connection between detonator 402 and the electrical circuit 124 of switch 120 via multi-contact bulkhead connector 160. In some embodiments, a compliant material (e.g., rubber) may be positioned and compressed at the interface between snap connector 434 and multi-contact bulkhead connector 160 to dampen or prevent vibration and to further inhibit disconnection of the snap connector 434 from the multi-contact bulkhead connector 160. Additionally, as described above, detonator assembly 400 fits within the detonator receptacle 364 of lower electrical connector 350. Moreover, detonator assembly 400 is configured to permit relative rotation between lower electrical connector 350 and multi-contact bulkhead connector 160 when detonator 402 is electrically connected to the upper electrical connector 172 of multi-contact bulkhead connector 160.

Figure 12:
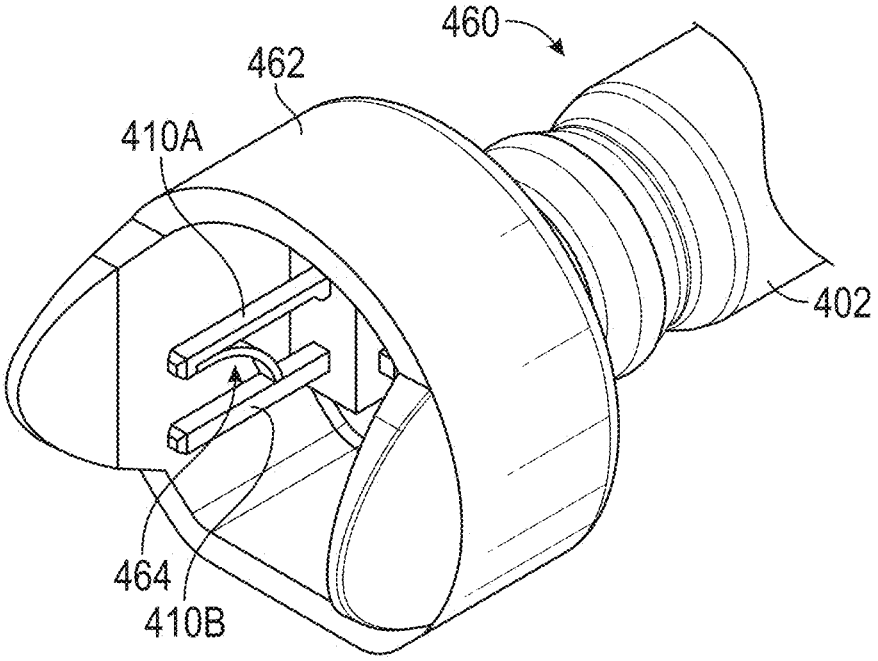
FIG. 12 is a perspective view of another embodiment of a detonator assembly of the tool string of FIG. 1 in accordance with principles disclosed herein.
Figure 13A:
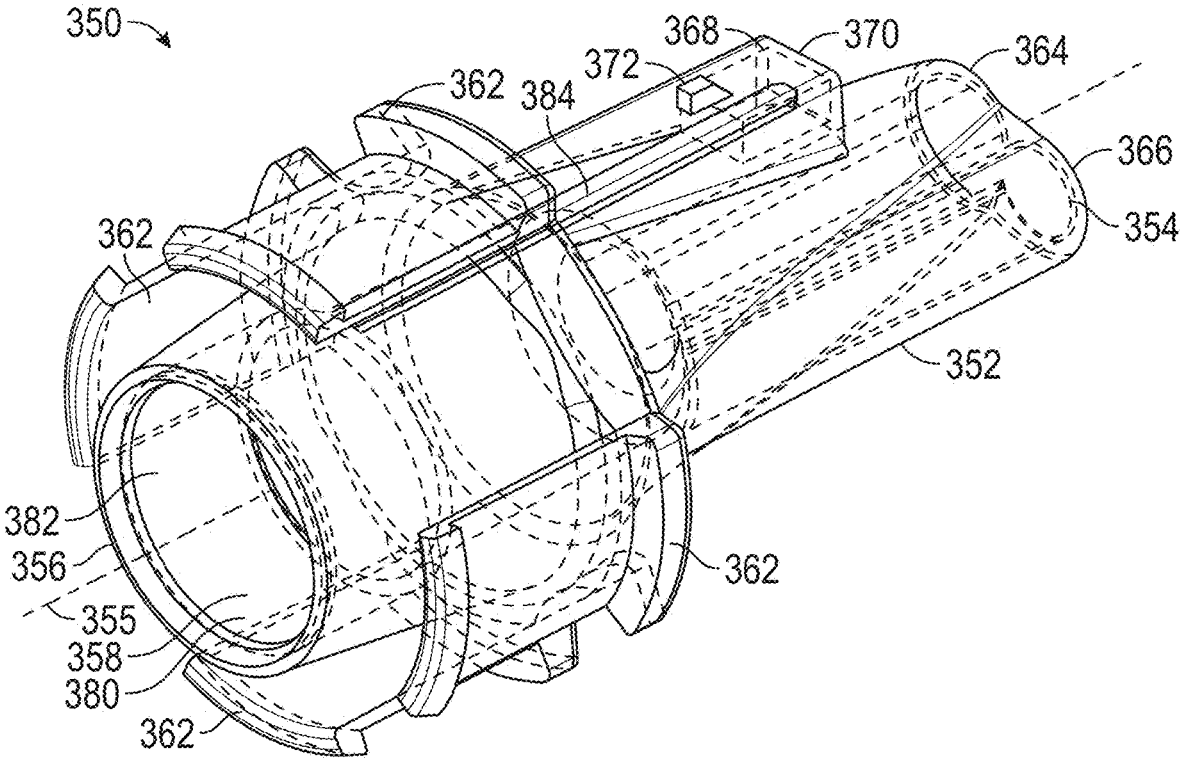
FIGS. 13A-13C are perspective views of an embodiment of an electrical connector of the perforating guns of FIG. 2 in accordance with principles disclosed herein.
Figure 13B:
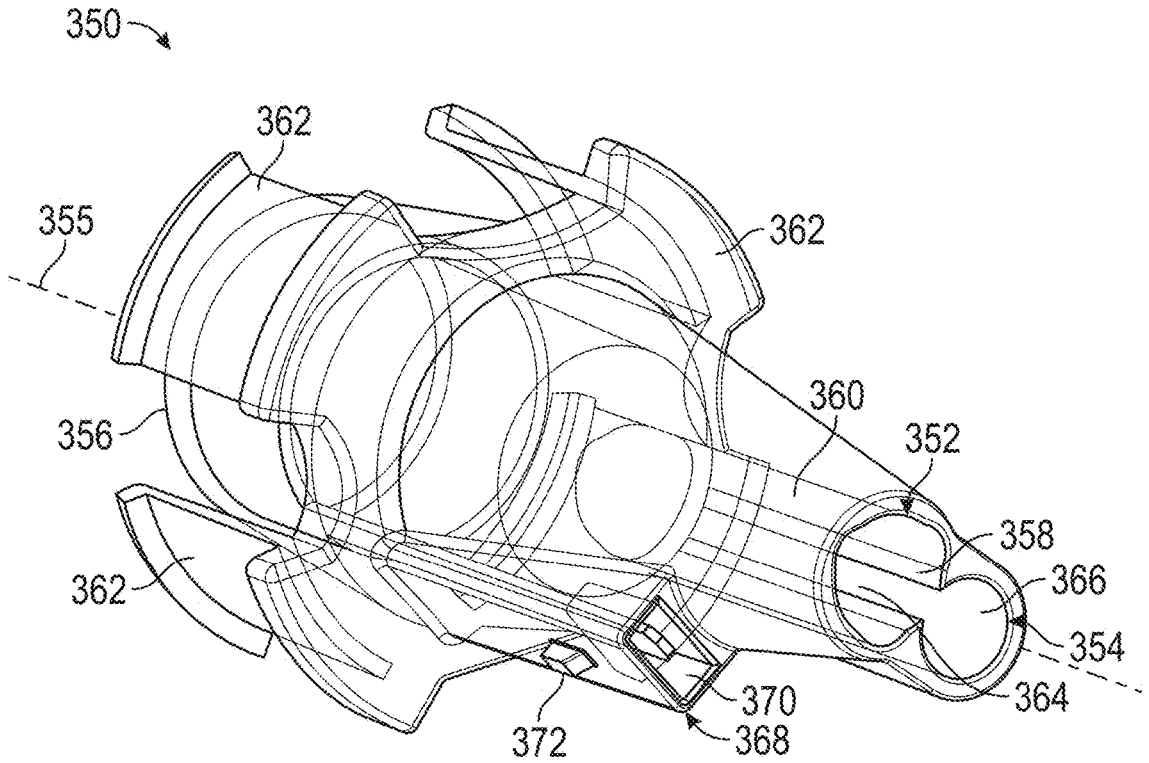
Figure 13C:
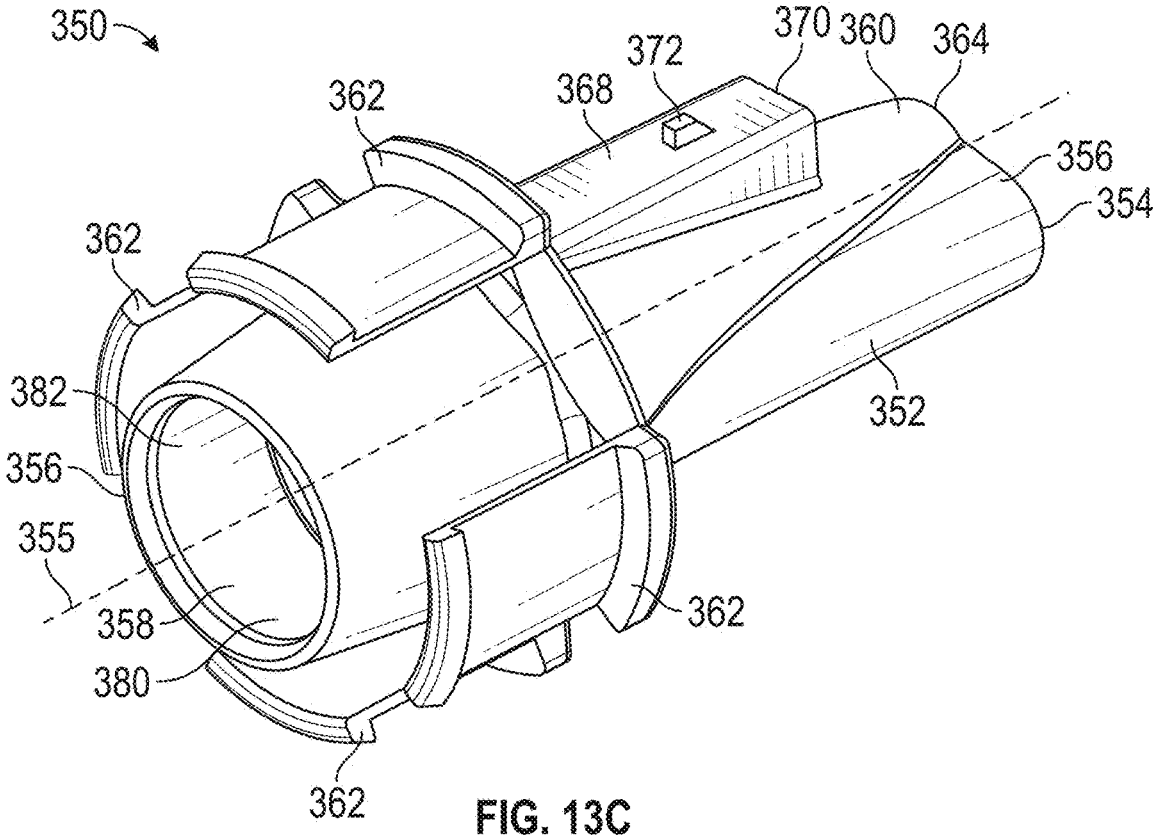

In this embodiment, prior to installation of detonator assembly 20 within one of the components of tool string 20, detonator assembly 400 includes a shunt cap 440 configured to prevent the accidental initiation of detonator 402. Particularly, when detonator assembly 400 is in the assembled configuration (shown in FIGS. 9A-9C), shunt cap 440 may be coupled to terminals 410 to directly short electrically connect terminals 410. Shunt cap 440 may be removed prior to the assembly of tool string 20 to permit the electrical connection of detonator 402 with another component of tool string 20, such as multi-contact bulkhead connector 160. Referring briefly to FIG. 12, another embodiment of a detonator assembly 460 is shown. In the embodiment of FIG. 12, detonator assembly 460 includes detonator 402, a connector housing 462 (similar in functionality as the connector housing 420 of FIGS. 9A-11), and an integrated shunt or spring connector 464 that provides a direct electrical connection or electrical short between terminals 410 of detonator 402.

Integrated shunt 464 is affixed or coupled to a first of the terminals 410A of detonator assembly 460 and is biased into contact with a second of the terminals 410B to provide a direct electrical connection between terminals 410A, 410B. Unlike the shunt cap 440 of detonator assembly 400, integrated shunt 464 does not need to be mechanically removed from detonator assembly 460 prior to the assembly of tool string 20. Instead, as terminals 410A, 410B of detonator 402 are inserted into the female contacts of the upper electrical connector 172 of multi-contact bulkhead connector 160, the upper electrical connector 172 contacts integrated shunt 464 and bends or flexes shunt 464 out of contact with the second terminal 410B, thereby removing the electrical short formed between terminals 410A, 410B. Direct electrical contact or an electrical short may be reestablished between terminals 410A, 410B by uncoupling detonator assembly 460 from multi-contact bulkhead connector 160, thereby permitting integrated shunt 464 to flex into contact with second terminal 410B. Thus, integrated shunt 464 may be biased into contact with second terminal 410B. Thus, integrated shunt 464 may prevent inadvertent initiation of detonator 402 while reducing the time required for assembling tool string 20 by eliminating the need to insert and remove a mechanical shunt from detonator assembly 460 prior to coupling detonator assembly 460 with multi-contact bulkhead connector 160.

Referring again to FIGS. 2-5, the direct connect sub 500 of tool string 20 is shown in FIG. 4. In the embodiment of FIGS. 2-5, direct connect sub 500 generally includes an outer housing 502, an electronic second or safety switch 520, a single-contact bulkhead connector 220, and a single-contact biased bulkhead connector 560. Housing 502 of direct connect sub 500 has a first or upper end 504, a second or lower end 506, a central bore or passage defined by a generally cylindrical inner surface 508 extending between ends 504, 506, and a generally cylindrical outer surface 510 extending between ends 504, 506. In this embodiment, the upper end 504 forms a neck or pin 511 that is insertable into a lower end of the CCL 26 of tool string 20. The outer surface 510 of housing 502 includes a pair of annular first or upper seal assemblies 512A, a pair of annular second or lower seal assemblies 512B, and a pair of releasable or threaded connectors 513 positioned at the ends 504, 506 of housing 502. Lower seal assemblies 512B of housing 502 sealingly engage the inner surface 310 of the housing 302 of upper perforating gun 300A while the threaded connector 513 positioned at lower end 506 releasably or threadably connects to a corresponding threaded connector positioned at the upper end 304 of housing 302.

In this embodiment, the central passage of housing 502 includes a switch receptacle 514, an upper bulkhead receptacle 515 extending between upper end 504 and switch receptacle 514, and a lower bulkhead receptacle 516 extending between switch receptacle 514 and the lower end 506 of housing 502. An annular first or upper shoulder 517 of the inner surface 508 of housing 502 separates upper bulkhead receptacle 515 and switch receptacle 514 while an annular second or lower shoulder 519 of inner surface 508 separates lower bulkhead receptacle 516 from switch receptacle 514. Safety switch 520 is disposed in switch receptacle 514, biased bulkhead connector 560 is disposed in upper bulkhead receptacle 515, and single-contact bulkhead connector 220 is disposed in lower bulkhead receptacle 516. Although in this embodiment safety switch 520 is housed within direct connect sub 500, in other embodiments, safety switch 520 may be located in a component of tool string 20 other than direct connect sub 500. For example, in an embodiment where tool string 20 comprises a release tool configured to release at least a portion of tool string 20, safety switch 520 may be positioned in a safety sub located between CCL 26 and the release tool, the release tool being positioned between the safety sub and direct connect sub 500.

Referring to FIGS. 3, 16A-17B, an embodiment of safety switch 520 of direct connect sub 500 is shown in FIGS. 16A-17B. As will be described further herein, safety switch 520 of direct connect sub 500 is configured to selectably restrict signal and/or data communication between wireline 22 and components of tool string 20 positioned downhole of direct connect sub 500 (e.g., switch sub 100, perforating guns 300A, 300B, plug-shoot firing head 600, etc.). Thus, safety switch 520 is configured to act as a safety feature to prevent premature activation of electrical components of tool string 20 positioned downhole of direct connect sub 500.

Safety switch 520 has a longitudinal or central axis 525, an axial maximum length 520L (extending along central axis 525), and a maximum diameter 520D (extending orthogonal central axis 525). In the embodiment of FIGS. 3, 16A-17B, safety switch 520 generally includes a printed circuit board (PCB) 522 having an electrical circuit 524 (shown schematically in FIG. 16A) including electronic components positioned thereon. In this embodiment, the electronic components of electrical circuit 524 include a processor and a memory, such as a reprogrammable memory; however, in other embodiments, the electronic components of electrical circuit 524 may vary. PCB 522 and electrical circuit 524 are centrally positioned in a housing or potting compound 526 (shown transparently in FIG. 16A for clarity) having a cylindrical outer surface 528. In this embodiment, the outer surface 528 of potting compound 526 comprises an annular shoulder 530 which, in at least one respect, differentiates the exterior shape of safety switch 520 from the gun switch 120 shown in FIGS. 6A-6D.

By providing safety switch 520 with an exterior shape which differs from an exterior shape of gun switch 120, safety switch 520 may be easier to visually distinguish from gun switch 120 in the field by operators or personnel of completion system 10, thereby reducing the likelihood of a safety switch 520 being mistakenly installed in a switch sub 100 and/or a gun switch 120 being mistakenly installed in a direct connect sub 500 by personnel of completion system 10. In some embodiments, the maximum length 520L and/or maximum diameter 520D of safety switch 520 differs from the maximum length 120L and/or maximum diameter 120D of gun switch 120 to further distinguish safety switch 520 from gun switch 120. Potting compound 526 comprises a solid or gelatinous material configured to provide electrical insulation and resistance to shock and/or vibration at elevated temperatures (e.g., 300-350 degrees Fahrenheit or greater) to thereby protect electrical circuit 524. In some embodiments, potting compound 526 comprises an epoxy resin; however, in other embodiments, the material from which potting compound 526 is comprised may vary. Additionally, the potting compound 526 of safety switch 520 may comprise a material which differs from the material comprising the potting compound 126 of gun switch 120.

In this embodiment, the electrical circuit 524 positioned on the PCB 522 of safety switch 520 includes a first or upper electrical connector 535, a second or lower electrical connector 540, and a pair of circumferentially spaced ground contacts 550. Electrical connectors 535, 540 each extend along central axis 525 while ground contacts 550 are offset from central axis 525 and extend radially outwards therefrom. As shown particularly in FIG. 16C, upper electrical connector 530 comprises a single wireline circuit or female contact 536. As shown particularly in FIG. 16D, lower electrical connecter 540 comprises a single wireline circuit or female contact 542. The wireline contacts 536, 542 of electrical connectors 535, 540, respectively, allow for electrical signals and/or data to be selectably communicated from wireline 22 to components of tool string 20 positioned downhole of direct connect sub 500 (e.g., switch sub 100, perforating guns 300A, 300B, plug-shoot firing head 600, etc.).

In this embodiment, the ground contacts 550 of electrical circuit 524 extend radially outwards from the outer surface 528 of potting compound 526 and are configured to contact inner surface 508 of the switch receptacle 514 of housing 502 to thereby ground the electrical circuit 524 of safety switch 520 to housing 502. In some embodiments, each ground contact 550 comprises a biasing member configured to bias ground contacts 550 into engagement with the inner surface 508 of housing 502, thereby maintaining contact between ground contacts 550 and the housing 502 of direct connect sub 500.

Figure 4:
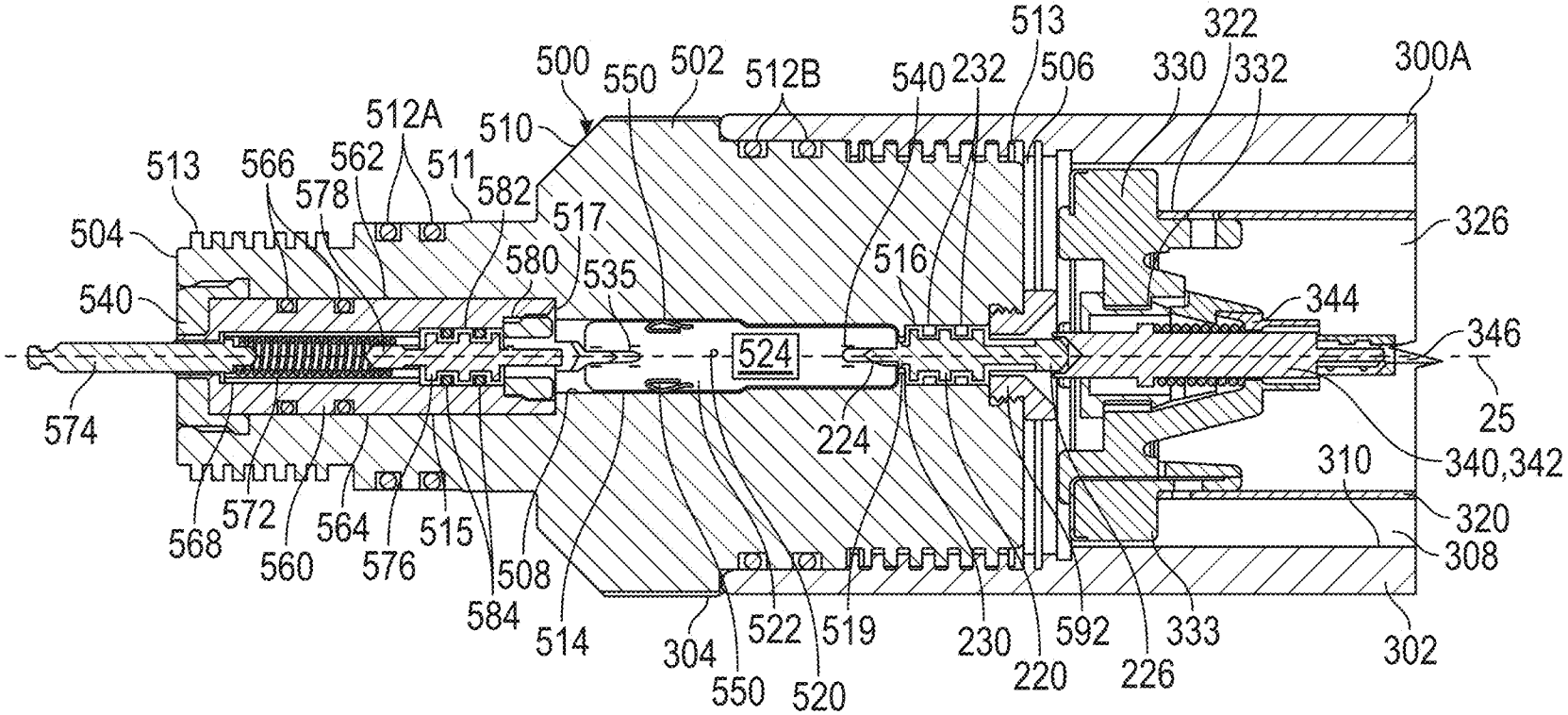
FIG. 4 is a cross-sectional view along line 3-3 of FIG. 2 of the direct connect sub of FIG. 2.

As shown particularly in FIG. 4, the biased bulkhead connector 560 generally includes a housing 562, a biasing member 572, a generally cylindrical first or upper electrical conductor 574, and a generally cylindrical second or lower electrical conductor 576. Housing 562 is positioned in upper bulkhead receptacle 515 the housing 502 of direct connect sub 500 and includes a generally cylindrical outer surface 564 extending between opposing ends thereof. In this embodiment, outer surface 564 of housing 562 includes a pair of annular seal assemblies 566 positioned thereon which sealingly engage the inner surface 508 of housing 502. Additionally, housing 562 includes a central bore or passage 568 in which biasing member 572 is received. A lower end of upper electrical conductor 574 couples to an upper end of biasing member 572, forming an electrical connection therebetween. In this embodiment, an inner surface of an upper end of housing 562 may have an electrical insulator positioned or formed thereon to prevent direct electrical contact between upper electrical conductor 574 and housing 562. An annular first or upper retainer 590 releasably or threadably couples to the inner surface 508 of housing 502 at the upper end 504 thereof. Upper retainer 590 retains or locks biased bulkhead connector 560 within upper bulkhead receptacle 515 of housing 502.

The lower electrical conductor 576 of biased bulkhead connector 560 includes a first or upper male contact 578, and a second or lower male contact 580. Upper male contact 578 of lower electrical conductor 576 is coupled to biasing member 572, forming an electrical connection between upper electrical conductor 574 and lower electrical conductor 576. Additionally, the lower end 580 of lower electrical conductor 576 is insertable into the female contact 536 of the upper electrical connector 535 of safety switch 520, thereby providing an electrical connection between lower electrical conductor 576 and the electrical circuit 524 of safety switch 520.

An annular insulation sleeve 582 surrounds lower electrical conductor 576 to prevent direct electrical contact from forming between lower electrical conductor 576 and the inner surface of housing 562. Additionally, a pair of annular seal assemblies 584 surround insulation sleeve 582 and sealingly engage the inner surface of housing 562. In this configuration, seal assemblies 578 disposed about housing 562 and seal assemblies 584 disposed about insulation sleeve 582 restrict fluid communication between the upper bulkhead receptacle 515 and the switch receptacle 514 of housing 502. In this embodiment, biasing member 572 acts against upper electrical conductor 574 to bias conductor 574 in a first or upwards axial direction. Additionally, biasing member 572 acts against lower electrical conductor 576 to bias conductor 576 in a second or lower axial direction, opposite the upper axial direction. In this manner, biasing member 572 biases upper electrical conductor 574 into electrical contact with a corresponding electrical connector of CCL 26 (not shown in FIG. 4), and biases lower electrical conductor 576 into electrical contact with safety switch 520. In this embodiment, force applied to biased bulkhead connector 560 due to pressure applied to an upper end biased bulkhead connector 560 is transferred to housing 502 via contact between a lower end of biased bulkhead connector 560 and the upper shoulder 517 of housing 102, thereby restricting pressure applied to the upper end of biased bulkhead connector 560 from being communicated to safety switch 520.

As described above, a single-contact bulkhead connector 220, similar in configuration as the bulkhead connector 220 of switch sub 100, is positioned in the lower bulkhead receptacle 516 of housing 502. The upper male contact 224 of the electrical conductor 222 of single-contact bulkhead connector 220 is insertable into the female contact 542 of the lower electrical connector 540 of safety switch 520, thereby providing an electrical connection between electrical conductor 222 of single-contact bulkhead connector 220 and the electrical circuit 524 of safety switch 520. Additionally, the lower male contact 226 of electrical conductor 222 is configured to contact the electrical conductor 342 of the upper endplate 330 of upper perforating gun 300A to form an electrical connection between the electrical conductor 222 of single-contact bulkhead connector 220 and the charge tube cable 346 of upper perforating gun 300A. An annular second or lower retainer 592 releasably or threadably couples to the inner surface 508 of housing 502 at the lower end 506 thereof. Lower retainer 592 retains or locks single-contact bulkhead connector 220 within the lower bulkhead receptacle 516 of housing 502. In this embodiment, force applied to single-contact bulkhead connector 220 due to pressure applied to a lower end of bulkhead connector 220 is transferred to housing 502 via contact between an upper end of bulkhead connector 220 and the lower shoulder 519 of housing 502, thereby restricting pressure applied to the lower end of bulkhead connector 220 from being communicated to safety switch 520.

Referring again to FIGS. 2-5, 18A-19B, the plug-shoot firing head 600 of tool string 20 is shown in FIG. 5. In the embodiment of FIGS. 2-5, 18A-19B, plug-shoot firing head 600 generally includes an outer housing 602, an electronic third or combination switch 620, and a multi-contact bulkhead connector 160. Housing 602 of plug-shoot firing head 600 has a first or upper end 604, a second or lower end 606, a central bore or passage defined by a generally cylindrical inner surface 608 extending between ends 604, 606, and a generally cylindrical outer surface 610 extending between ends 604, 606. In this embodiment, the lower end 606 forms a neck or pin 611 that is insertable into tool 30 of tool string 20. The outer surface 610 of housing 602 includes a pair of annular first or upper seal assemblies 612A, a pair of annular second or lower seal assemblies 612B, and a pair of releasable or threaded connectors 613 positioned at the ends 604, 606 of housing 602. Upper seal assemblies 612A of housing 602 sealingly engage the inner surface 310 of the housing 302 of lower perforating gun 300B while the threaded connector 613 positioned at lower end 606 releasably or threadably connects to a corresponding threaded connector positioned at an upper end of setting tool 30.

In this embodiment, the central passage of housing 602 includes a switch receptacle 614, an upper bulkhead receptacle 615 extending between upper end 604 and switch receptacle 614, and an igniter receptacle 616 extending between switch receptacle 614 and the lower end 606 of housing 602. An annular first or upper shoulder 617 of the inner surface 608 of housing 602 separates upper bulkhead receptacle 615 and switch receptacle 614 while an annular second or lower shoulder 619 of inner surface 608 separates igniter receptacle 616 from switch receptacle 614. Combination switch 620 is disposed in switch receptacle 614, multi-contact bulkhead connector 160 is disposed in upper bulkhead receptacle 515, and an igniter assembly 700 of the setting tool 30 (not shown in FIG. 5) is partially received in igniter receptacle 616.

As shown particularly in FIGS. 18A-19B, an embodiment of combination switch 620 of plug-shoot firing head 600 is shown in FIGS. 18A-19B. As will be described further herein, combination switch 620 of plug-shoot firing head 600 is configured to selectably actuate both the setting tool 30 and lower perforating gun 300B of tool string 20. Combination switch 620 has a longitudinal or central axis 625 (shown in FIG. 18A), an axial maximum length 620L (extending along central axis 625 and shown in FIG. 18B), and a maximum diameter 620D (extending orthogonal central axis 625 and shown in FIG. 18B). In the embodiment of FIGS. 5, 18A-19B, combination switch 620 generally includes a printed circuit board (PCB) 622 having an electrical circuit 624 (shown schematically in FIG. 18A) including electronic components positioned thereon. In this embodiment, the electronic components of electrical circuit 624 include a processor and a memory, such as a reprogrammable memory; however, in other embodiments, the electronic components of electrical circuit 624 may vary. PCB 622 and electrical circuit 624 are centrally positioned in a housing or potting compound 626 (shown transparently in FIG. 18A for clarity) having a cylindrical outer surface 628. Potting compound 626 comprises a solid or gelatinous material configured to provide electrical insulation and resistance to shock and/or vibration at elevated temperatures (e.g., 300-350 degrees Fahrenheit or greater) to thereby protect electrical circuit 624. In some embodiments, potting compound 626 comprises an epoxy resin; however, in other embodiments, the material from which potting compound 626 is comprised may vary. Additionally, the potting compound 626 of combination switch 620 may comprise a material which differs from the material comprising the potting compound 126 of switches 120, 520.

Combination switch 620 has an exterior shape that differs from the exterior shapes of switches 120, 520. For example, the maximum length 620L and/or maximum diameter 620D of combination switch 620 may differ from the maximum lengths 120L, 520L and/or maximum diameters 120D, 520 of switches 120, 520, respectively. In other embodiments, the exterior shape of combination switch 620 may differ from the exterior shapes of switches 120, 520 in other ways (e.g., a different cross-sectional shape, the inclusion of surface features, etc.). By providing combination switch 620 with a different exterior shape than the exterior shapes of switches 120, 520, combination switch 620 is easier to distinguish from switches 120, 520 in the field by personnel of completion system 10.

In this embodiment, the electrical circuit 624 positioned on the PCB 622 of combination switch 620 includes a first or upper electrical connector 630, a second or lower electrical connector 640, and a pair of circumferentially spaced ground contacts 650. As shown particularly in FIG. 18C, upper electrical connector 630 comprises a wireline circuit or female contact 632 and a pair of detonator circuits or female contacts 634. As shown particularly in FIG. 18D, lower electrical connecter 640 comprises a single wireline circuit or female contact 642. The wireline contacts 632, 642 of electrical connectors 630, 640 allow for electrical signals and/or data to be selectably communicated from wireline 22 to components of tool string 20 positioned downhole of plug-shoot firing head 600 (e.g., setting tool 30).

The detonator contacts 634 of upper electrical connector 630 allow for electrical signals to be selectably communicated between wireline 22 and a detonator of lower perforating gun 300B, as will be described further herein. Ground contacts 650 extend radially outwards from the outer surface 628 of potting compound 626 and are configured to contact inner surface 608 of the switch receptacle 614 of housing 602 to thereby ground the electrical circuit 624 of combination switch 620 to housing 602. In some embodiments, each ground contact 650 comprises a biasing member configured to bias ground contacts 650 into engagement with inner surface 608, thereby maintaining contact between ground contacts 650 and housing 602.

Figure 5:
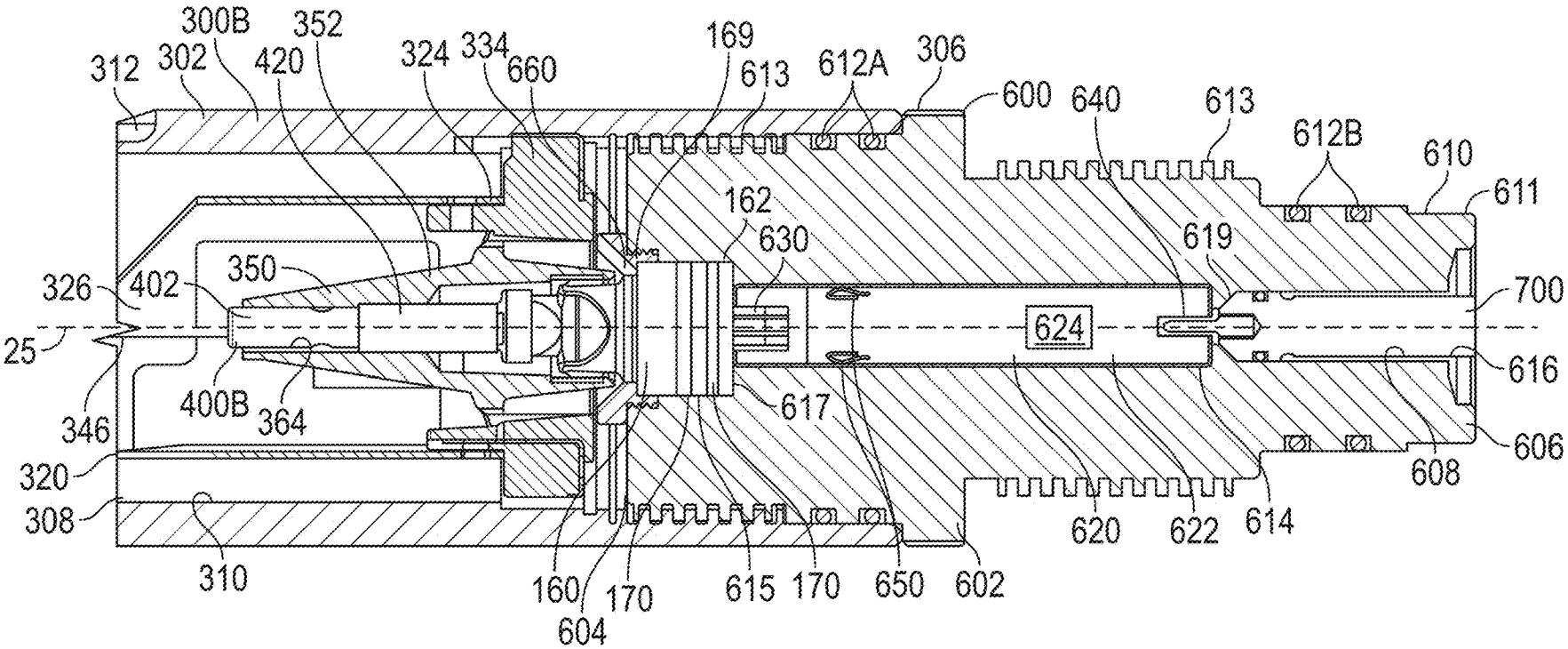
FIG. 5 is a cross-sectional view along line 3-3 of FIG. 2 of the plug-shoot firing head of FIG. 2.
Figure 6A:
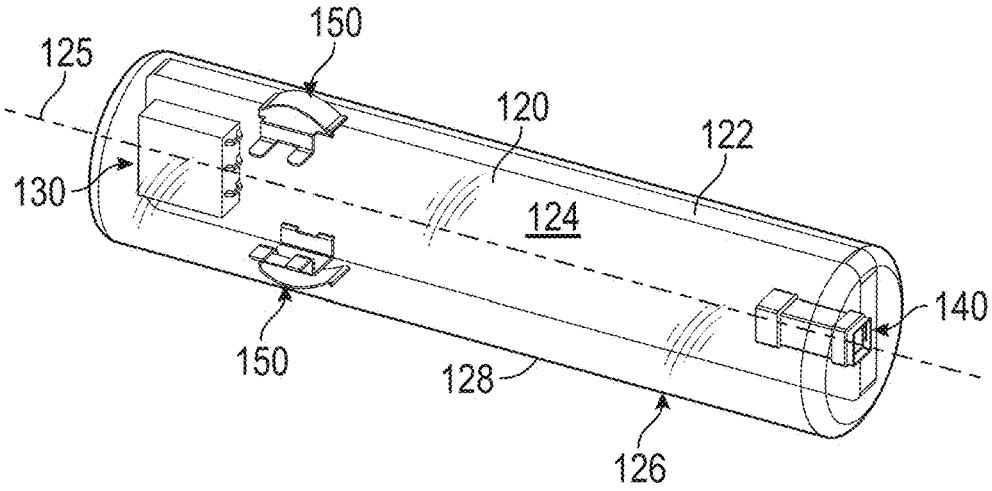
FIG. 6A is a perspective view of an embodiment of a first switch of the switch sub of FIG. 2 in accordance with principles disclosed herein.
Figure 6B:
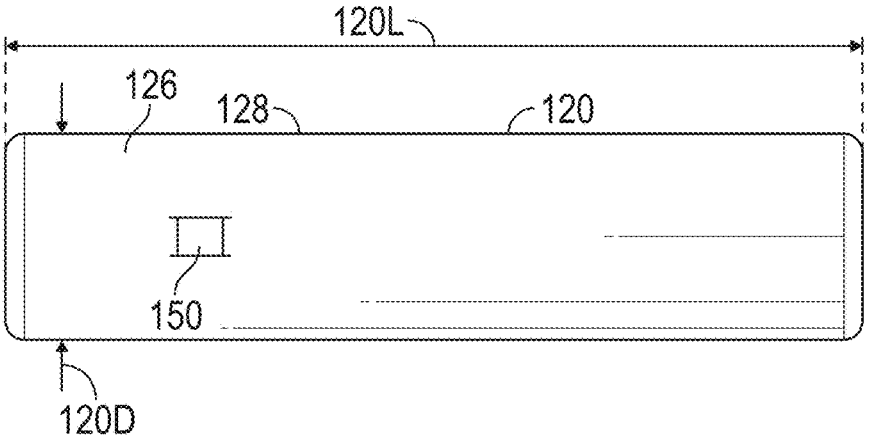
FIG. 6B is a side view of the first switch of FIG. 6A.
Figure 6C:
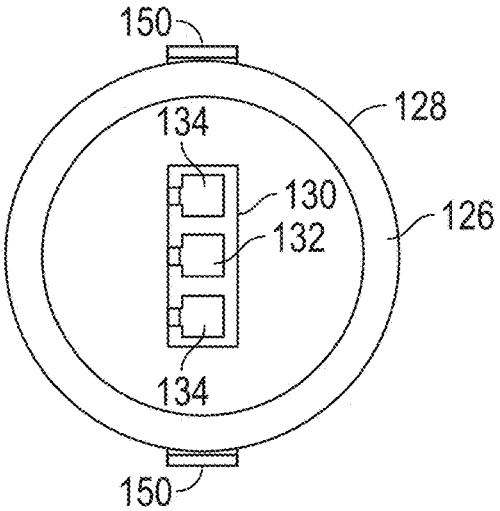
FIG. 6C is a front view of the first switch of FIG. 6A.
Figure 6D:
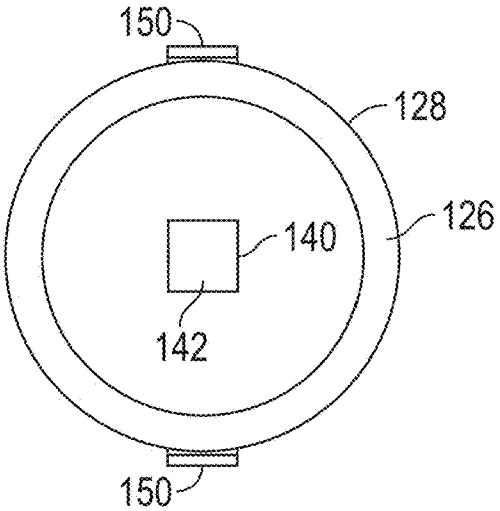
FIG. 6D is a rear view of the first switch of FIG. 6A.
Figure 7A:
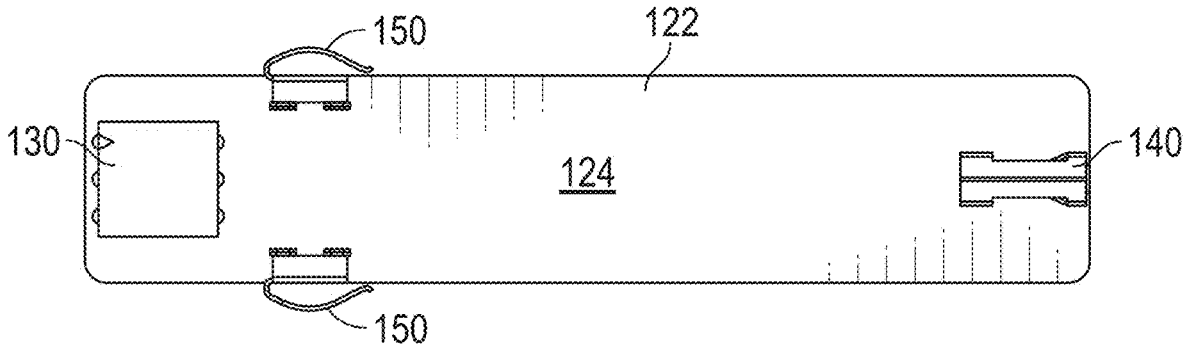
FIG. 7A is a top view of an embodiment of a printed circuit board (PCB) of the first switch of FIG. 6A in accordance with principles disclosed herein.
Figure 7B:
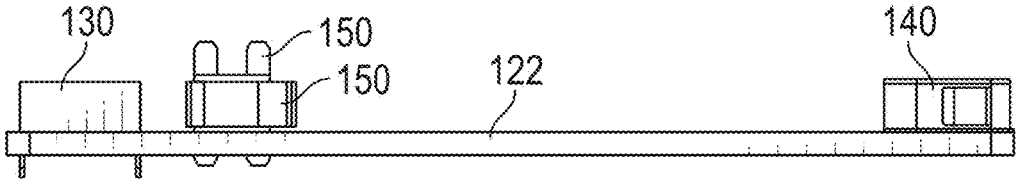
FIG. 7B is a side view of the PCB of FIG. 7A.

As shown particularly in FIG. 5, multi-contact bulkhead connector 160, received in upper bulkhead receptacle 615 of housing 602, electrically connects with the lower electrical connector 350 and lower detonator assembly 400B, thereby providing an electrical connection between combination switch 620 and both the charge tube cable 346 and lower detonator assembly 400B. In this embodiment, plug-shoot firing head 600 includes an annular retainer 660 having an outer surface that includes a releasable or threaded connector which releasably or threadably connects to a corresponding threaded connector formed on the inner surface 608 of upper bulkhead receptacle 615 to couple retainer 660 to housing 602. Additionally, an inner surface of retainer 680 includes an annular shoulder that matingly engages the annular shoulder 169 of multi-contact bulkhead connector 160 to thereby retain upper bulkhead connector 160 within upper bulkhead receptacle 615 and limit relative axial movement between multi-contact bulkhead connector 160 and housing 602.

In this embodiment, force applied to the multi-contact bulkhead connector 160 of plug-shoot firing head 600 due to pressure applied to the upper end 164 of upper bulkhead connector 160 is transferred to housing 602 via contact between the lower end 166 of bulkhead connector 160 and the upper shoulder 617 of housing 602, thereby restricting pressure applied to upper end 164 of upper bulkhead connector 160 from being communicated to combination switch 620. Additionally, force applied to igniter assembly 700 due to pressure applied to a lower end thereof is transferred to housing 602 via contact between an upper end of igniter assembly 700 and the lower shoulder 619 of housing 602, thereby restricting pressure applied to the lower end of igniter assembly 700 from being communicated to combination switch 620.

Having described structural features of tool string 20, an embodiment of a method for assembling and operating tool string 20 will now be described. As will be described further herein, at least some components of tool string 20 may be assembled by the manufacturer, or the end user or operator of tool string 20 prior to transporting tool string 20 to a well site (e.g., the location of wellbore 4) of completion system 10. The remaining components of tool string 20 may be assembled at the wellsite of completion system 10 but prior to the insertion of tool string 20 into wellbore 4.

In this embodiment, detonator assemblies 400A, 400B of tool string 20 are assembled by the manufacturer, with required safeguards in place, prior to transportation of tool string 20 to the wellsite of completion system 10. Referring to FIGS. 20-23, in an embodiment, each detonator assembly 400 may be assembled by first cutting and stripping a portion of each electrical insulator 408 from each wire 406 to expose a predetermined length of each wire 406 to the surrounding environment. As shown particularly in FIG. 20, following the cutting and stripping of electrical insulators 408, terminals 410 are attached to the terminal ends of the exposed wires 406. In some embodiments, terminals 410 may be crimped to wires 406; however, in other embodiments, terminals 410 may be attached to wires 406 via other mechanisms.

Figure 21:
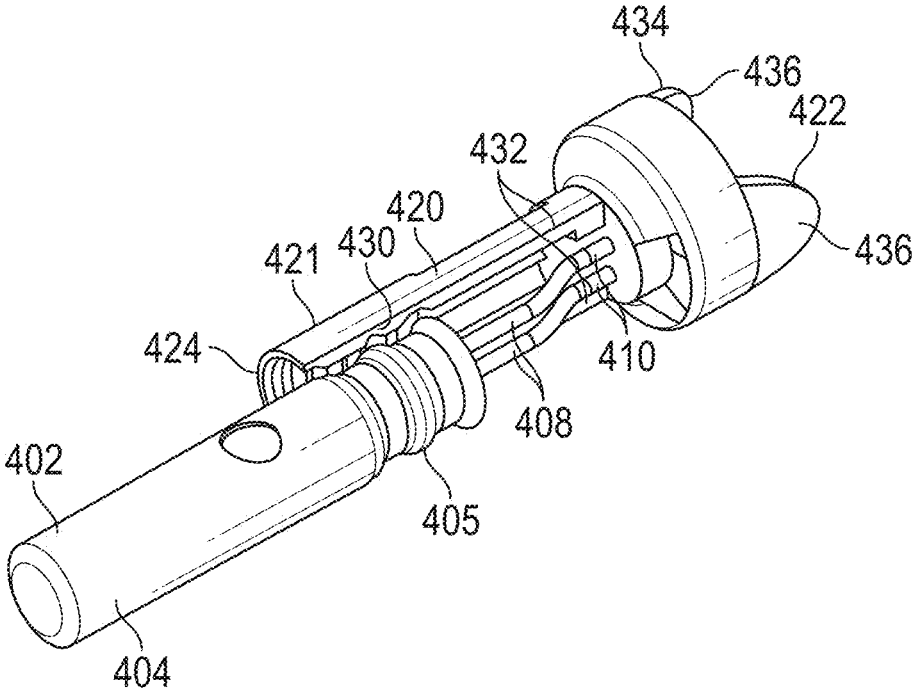
Figure 22:
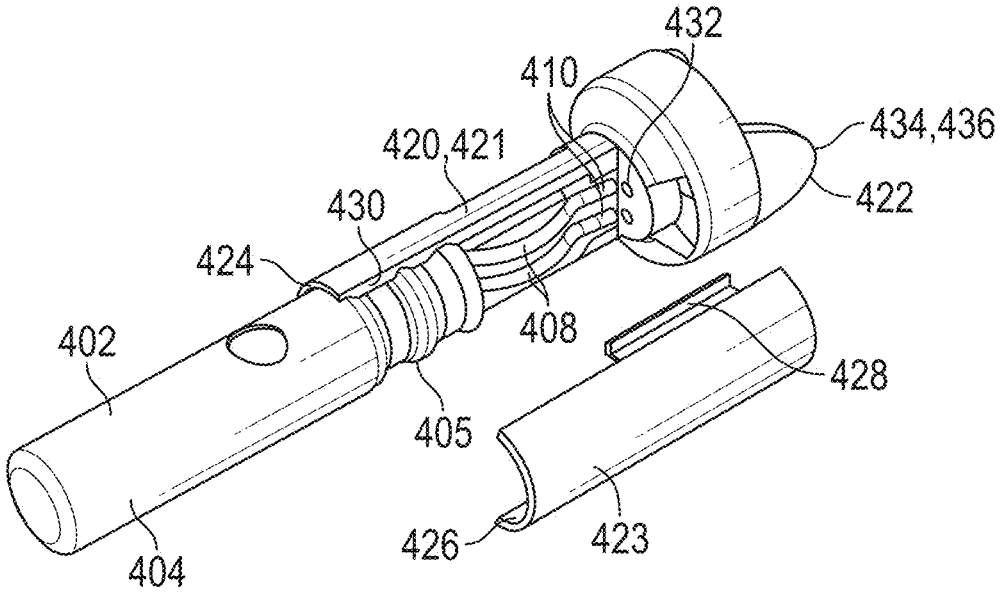
Figure 23:
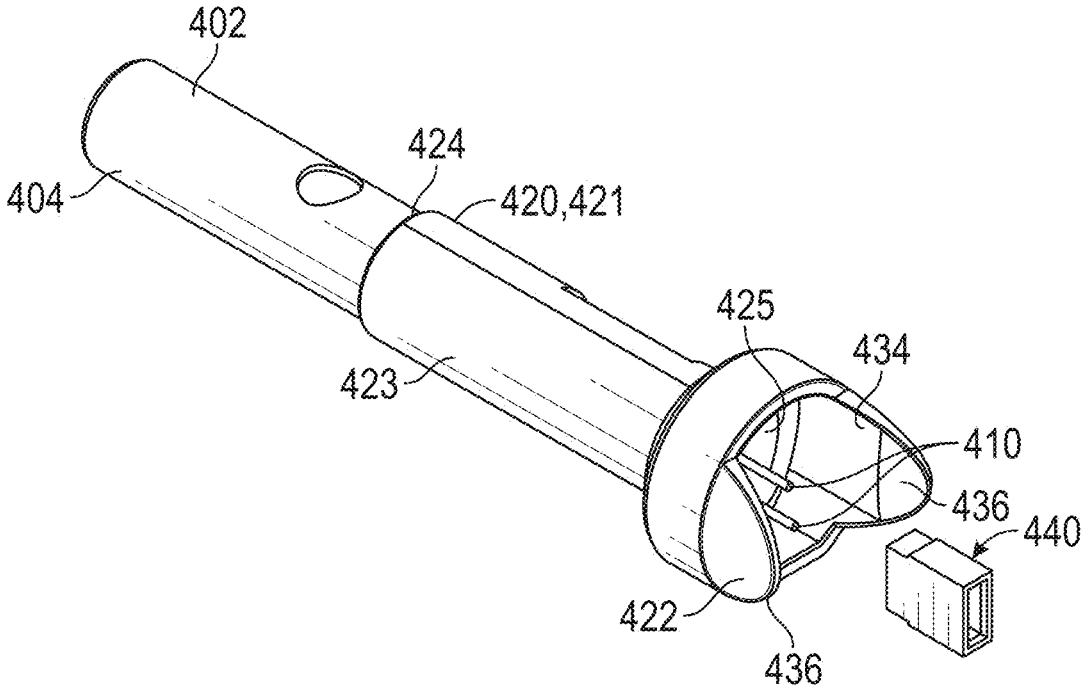
Figure 24:
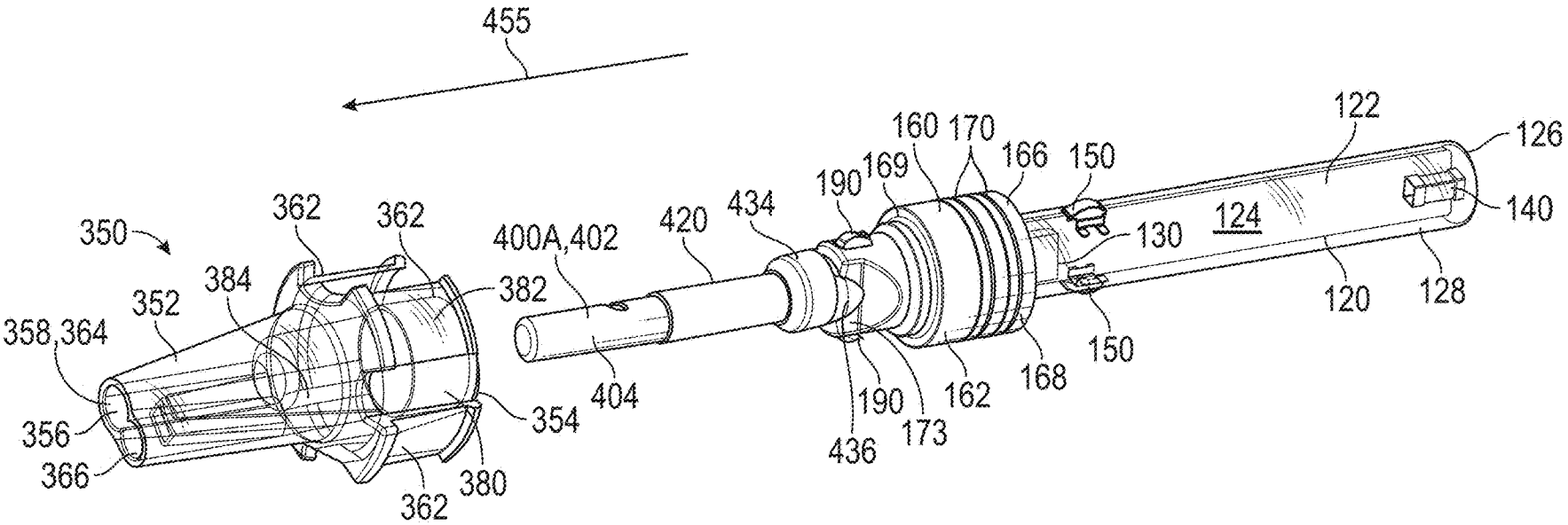
FIG. 24 is a perspective view showing an embodiment of a method for assembling the switch and one of the perforating guns of FIG. 2.

As shown in FIG. 21, with terminals 410 attached to the terminal ends of wires 406, terminals 410 are inserted through apertures 432 of the first arcuate portion 421 of connector housing 420, and the shoulder 405 of detonator housing 404 is snapped into the groove 430 of first arcuate portion 421 thereby coupling detonator housing 404 to the first arcuate portion 421 of connector housing 420. As shown particularly in FIG. 22, with detonator housing 404 coupled to the first arcuate portion 421 of connector housing 420, the second arcuate portion 423 of connector housing 420 is coupled to first arcuate portion 421 via the insertion of the snap connector 428 of second arcuate portion 423 into the corresponding groove formed in first arcuate portion 421. In this embodiment, as shown in FIG. 23, terminals 410 are inserted into shunt cap 440 to prevent the inadvertent initiation of the detonator 402 of detonator assembly 400. Shunt cap 440 is removed from detonator assembly 400 when tool string 20 is assembled at the well site of completion system 10. In other embodiments, an integrated shunt (e.g., integrated shunt 464 shown in FIG. 12) may be utilized, eliminating the need to insert terminals 410 into shunt cap 464 as well as the need to remove shunt cap 464 prior to installation of detonator assembly 400 within one of the components of tool string 20.

Prior to assembling perforating guns 300A, 300B with the other components of tool string 20, as will be discussed further herein, the charge tube 320 of each perforating gun 300B is assembled and installed within its corresponding housing 302.

Particularly, in this embodiment, with charge tube 320 disposed external of its respective housing 302, endplates 330, 334 are attached by a user of perforating guns 300A, 300B and/or tool string 20 (e.g., a manufacturer, end user, etc., of tool string 20 or components thereof) to the ends 322, 324, respectively of charge tube 320 to thereby assemble charge tube 320. Lower electrical connector 350 is attached to lower endplate 334 prior to coupling lower endplate 334 to the lower end 324 of charge tube 320. In some embodiments, charge tube cable 346, which extends through charge tube 320, is electrically connected to the elongate contact of lower electrical connector 350 prior following the coupling lower endplate 334 to the lower end 324 of charge tube 320; however, in other embodiments, charge tube cable 346 is connected to lower electrical connector 350 prior to the coupling of lower endplate 334 to charge tube 320.

In this embodiment, following the assembly of endplates 330, 334, lower electrical connector 350, and charge tube cable 346, the user positions a plurality of explosive shaped charges in the openings formed in charge tube 320, and ballistically couples the detcord to each of the shaped charges coupled to charge tube 320. With the plurality of explosive shaped charged positioned in the openings of the charge tube 320, the user may insert an end of the detcord into the detcord receptacle 366 of lower electrical connector 350. An interference fit is formed between the end of the detcord and an inner surface of the detcord receptacle 366, and thus, friction between the end of the detcord and the inner surface of the detcord receptacle 366 prevents, or at least inhibits, removal of the end of the detcord from detcord receptacle 366. With the end of the detcord inserted into detcord receptacle 366, charge tube 320 may be loaded into its respective housing 302 by the user of perforating guns 300A, 300B, and/or tool string 20.

Referring again to FIGS. 2-5, in this embodiment, at least the lower portion of tool string 20 is assembled "top to bottom" with the assembly of direct connect sub 500 and upper perforating gun 300A occurring prior to the assembly of the components of tool string 20 configured to be positioned downhole from direct connect sub 500 and upper perforating gun 300A (e.g., switch sub 100, lower perforating gun 300B, plug-shoot firing head 600, etc.); however, in other embodiments, the lower portion of tool string 200 may be assembled "bottom to top" with the assembly of plug-shoot firing head 600 and lower perforating gun 300B occurring prior to the assembly of components of tool string 20 configured to be positioned uphole from lower perforating gun 300B and plug-shoot firing head 600 (e.g., direct connect sub 500, upper perforating gun 300A, switch sub 100, etc.). Particularly, in this embodiment, the upper electrical connector 535 of safety switch 520 is first electrically connected to the biased bulkhead connector 560 of direct connect sub 500. With safety switch 520 connected to biased bulkhead connector 560, safety switch 520 and biased bulkhead connector 560 are then inserted into the central passage of housing 502, with safety switch 520 being received in switch receptacle 514 and biased bulkhead connector 560 being received in upper bulkhead receptacle 515.

In some embodiments, the lower electrical connector 540 of safety switch 520 is electrically connected to the single-contact bulkhead connector 220 of direct connect sub 500, which is received in lower bulkhead receptacle 516 of housing 502, when safety switch 520 is inserted into the switch receptacle 514 of housing 502; however, in other embodiments, single-contact bulkhead connector 220 may be inserted into lower-bulkhead receptacle 516 and connected to safety switch 520 following the insertion of safety switch 520 into switch receptacle 514. Following the insertion of biased bulkhead connector 560 and single-contact bulkhead connector 220 into housing 502, retainers 590, 592 are coupled to the inner surface 508 of housing 502 to lock safety switch 520 and bulkhead connectors 560, 220 in the central passage of housing 502, and thereby complete the assembly of direct connect sub 500.

Following the assembly of direct connect sub 500, the lower end 506 of the housing 502 of direct connect sub 500 is inserted into the upper end 304 of the housing 302 of upper perforating gun 300A. As housing 502 of direct connect sub 500 is inserted into the housing 302 of upper perforating gun 300A, housing 502 is rotated relative to housing 302 to threadably connect a threaded connector 513 of housing 502 with a corresponding threaded connector positioned at the upper end 304 of housing 302. Additionally, as the housing 502 of direct connect sub 500 is inserted into the housing 302 of upper perforating gun 300A, lower male contact 226 of the single-contact bulkhead connector 220 of direct connect sub 500 contacts electrical conductor 342 of the upper electrical connector 340 of upper perforating gun 300A, thereby forming an electrical connection between safety switch 520 and the charge tube cable 346 of upper perforating gun 300A.

Referring to FIGS. 2-5, and 24, in this embodiment, following the assembly of direct connect sub 500 with upper perforating gun 300A, switch sub 100 of tool string 20 may be assembled with upper perforating gun 300A and lower perforating gun 300B. In this embodiment, the upper electrical connector 130 of gun switch 120 is electrically connected to lower electrical connector 180 of the multi-contact bulkhead connector 160 of switch sub 100. With gun switch 120 connected to multi-contact bulkhead connector 160, gun switch 120 and connector 160 are inserted into the central passage of housing 102, with gun switch 120 being received in switch receptacle 112 and multi-contact bulkhead connector 160 being received in upper bulkhead receptacle 114.

In some embodiments, the lower electrical connector 140 of gun switch 120 is electrically connected to single-contact bulkhead connector 220, which is received in lower bulkhead receptacle 116 of housing 102, when gun switch 120 is inserted into the switch receptacle 112 of housing 102; however, in other embodiments, single-contact bulkhead connector 220 may be inserted into lower-bulkhead receptacle 116 and connected to gun switch 120 following the insertion of gun switch 120 into switch receptacle 112. Following the insertion of multi-contact bulkhead connector 160 and single-contact bulkhead connector 220 into housing 102, retainers 200, 240 are coupled to the inner surface 108 of housing 102 to lock gun switch 120 and bulkhead connectors 160, 220 in the central passage of housing 102, and complete the assembly of switch sub 100.

In this embodiment, following the assembly of switch sub 100, upper detonator assembly 400A is connected to the multi-contact bulkhead connector 160 of switch sub 100. Particularly, arms 436 of the snap connector 434 of upper detonator assembly 400A are circumferentially aligned with the flanking engagement surfaces 173 of multi-contact bulkhead connector 160 and the engagement surfaces 171, 173 of connector 160 are inserted into and latched onto snap connector 434. With upper detonator assembly 400A connected to multi-contact bulkhead connector 160 of switch sub 100, switch sub 100 may be connected to the upper perforating gun 300A.

Particularly, in this embodiment, upper end 104 of the housing 102 of switch sub 100 is inserted into the lower end 306 of the housing 302 of upper perforating gun 300A. As housing 102 of switch sub 100 is inserted into the housing 302 of upper perforating gun 300A, housing 102 is rotated relative to housing 302 to threadably connect a threaded connector 118 of housing 102 with a corresponding threaded connector positioned at the lower end 306 of housing 302. Additionally, as housing 102 of switch sub 100 is inserted into the housing 302 of upper perforating gun 300A, detonator 402 of upper detonator assembly 400A is axially and slidably inserted into the detonator receptacle 364 of the lower electrical connector 350 (indicated by arrow 455 in FIG. 24, where housing 102 is hidden in FIG. 24 for clarity), thereby positioning detonator 402 adjacent the detcord positioned in detcord receptacle 366 of the lower electrical connector 350 of upper perforating gun 300A.

Also following the assembly of switch sub 100, the lower end 106 of the housing 102 of switch sub 100 is inserted into the upper end 304 of the housing 302 of lower perforating gun 300B. As housing 102 of switch sub 100 is inserted into the housing 302 of lower perforating gun 300B, housing 102 is rotated relative to housing 302 to threadably connect a threaded connector 118 of housing 102 with a corresponding threaded connector positioned at the upper end 304 of housing 302. Additionally, as the housing 102 of switch sub 100 is inserted into the housing 302 of lower perforating gun 300B, lower male contact 226 of single-contact bulkhead connector 220 contacts electrical conductor 342 of the upper electrical connector 340 of lower perforating gun 300B, thereby forming an electrical connection between gun switch 120 and the charge tube cable 346 of lower perforating gun 300B.

Referring again to FIGS. 2-5, following the assembly of lower perforating gun 300B, the plug-shoot firing head 600 and setting tool 30 of tool string 20 may be assembled. Particularly, in an embodiment, the upper electrical connector 630 of combination switch 620 is electrically connected to lower electrical connector 180 of the multi-contact bulkhead connector 160 of plug-shoot firing head 600. With combination switch 620 connected to multi-contact bulkhead connector 160, assembly 620 and connector 160 are inserted into the central passage of housing 602, with combination switch 620 being received in switch receptacle 614 and multi-contact bulkhead connector 160 being received in upper bulkhead receptacle 615.

In some embodiments, the lower electrical connector 640 of combination switch 620 is electrically connected to igniter assembly 700 when combination switch 620 is inserted into the switch receptacle 614 of housing 602; however, in other embodiments, igniter assembly 700 may be connected to combination switch 620 following the insertion of combination switch 620 into switch receptacle 614. With combination switch 620 and multi-contact bulkhead connector 160 received in the central passage of housing 602, housing 602 may be coupled to setting tool 30 of tool string 20. Additionally, retainer 660 is coupled to the inner surface 608 of housing 602 to lock combination switch 620 and multi-contact bulkhead connector 160 in the central passage of housing 602.

With combination switch 620 and multi-contact bulkhead connector 160 received in the central passage of housing 602, lower detonator assembly 400B is connected to multi-contact bulkhead connector 160. Particularly, arms 436 of the snap connector 434 of lower detonator assembly 400B are circumferentially aligned with the flanking engagement surfaces 173 of multi-contact bulkhead connector 160 and the engagement surfaces 171, 173 of connector 160 are inserted into and latched onto snap connector 434, thereby coupling lower detonator assembly 400B with multi-contact bulkhead connector 160.

Following the assembly of lower perforating gun 300B, upper end 604 of the housing 602 of plug-shoot firing head 600 may be inserted into the lower end 306 of the housing 302 of lower perforating gun 300B. As housing 602 of plug-shoot firing head 600 is inserted into the housing 302 of lower perforating gun 300B, housing 602 is rotated relative to housing 302 to threadably connect the threaded connector 613 of housing 602 with a corresponding threaded connector positioned at the lower end 306 of housing 302. Additionally, as housing 602 of plug-shoot firing head 600 is inserted into the housing 302 of lower perforating gun 300B, detonator 402 of lower detonator assembly 400B is axially inserted into the detonator receptacle 364 of the lower electrical connector 350, thereby positioning detonator 402 adjacent the detcord positioned in detcord receptacle 366 of the lower electrical connector 350 of lower perforating gun 300B. In this embodiment, detonator 402 is positioned along the central axis of lower perforating gun 300B while the end of the detcord, received in detcord receptacle 366, is offset from the central axis of lower perforating gun 300B. The positioning of detonator 402 adjacent the detcord is intended to place the shaped charge in ballistic communication with the gun switch 120 via the detonator 402 and detcord.

As detonator 402 is inserted through detonator receptacle 364 of the lower electrical connector 350, the annular contact 382 of lower electrical connector 350 contacts the radial contacts 190 of the multi-bulkhead connector 160 of plug-shoot firing head 600, thereby providing an electrical connection between the charge tube cable 346 of lower perforating gun 300B and multi-bulkhead connector 160. Lower electrical connector 350 of lower perforating gun 300B permits relative rotation between connector 350 and multi-contact bulkhead connector 160 as plug-shoot firing head 600 is rotatably coupled with lower perforating gun 300B. In some embodiments, the assembly of plug-shoot firing head 600 with setting tool 30 and lower perforating gun 300B, as described above, may be accomplished at the well site of completion system 10 or at a location distal the well site.

In this embodiment, following the assembly of plug-shoot firing head 600 with lower perforating gun 300B and setting tool 30, upper end 504 of the housing 502 of direct connect sub 500 may be releasably or threadably connected to a lower end of the CCL 26 of tool string 20. As direct connect sub 500 is connected to CCL 26, electrical conductor 574 contacts a corresponding conductor of CCL 26 to establish an electrical connection between the biased bulkhead connector 560 of direct connect sub 500 and CCL 26. The electrical connection between CCL 26 and direct connect sub 500 permits the selectable communication of signals and/or data between wireline 22 and components positioned downhole of direct connect sub 500 (e.g., switch sub 100, perforating guns 300A, 300B, plug-shoot firing head 600, etc.).

Referring to FIGS. 1-5, the component of tool string 20, including switch sub 100, perforating guns 300A, 300B, direct connect sub 500, and plug-shoot firing head 600, comprise "plug-and-play" components that do not need to be electrically wired together during the process of assembling tool string 20, thereby substantially reducing the time required for assembling tool string 20 while also reducing the probability of misassembling (e.g., incorrectly wiring electrical components, etc.) one or more components of tool string 20. Particularly, as described above, only the explosive shaped charges and detcord need to be installed in perforating guns 300A, 300B during the assembly of tool string 20, where the installation of detonators 402 and igniter assembly 700, and the electrical connections between components of tool string 20 being formed in response to rotatably coupling the components of tool string 20.

For example, an electrical connection permitting selectable communication of signals and/or data between the safety switch 520 of direct connect sub 500 and the gun switch 120 of switch sub 100 is formed by or in response to rotatably coupling the housing 102 of switch sub 100 to the housing 302 of upper perforating gun 300A and rotatably coupling the housing 302 of upper perforating gun 300A with the housing 502 of switch sub direct connect sub 500. Thus, in order to assemble direct connect sub 500, upper perforating gun 300A, and switch sub 100, the charge tube cable 346 of upper perforating gun 300A does not need to be electrically wired (e.g., by personnel of completion system 10) to either gun switch 120 or safety switch 520. Instead, the electrical connection between charge tube cable 346 with both safety switch 520 of direct connect sub 500 and gun switch 120 of switch sub 100 is made simply by axially inserting both direct connect sub 500 and switch sub 100 into the housing 302 of upper perforating gun 300A.

Similarly, an electrical connection permitting selectable communication of signals and/or data between the gun switch 120 of switch sub 100 and the combination switch 620 of plug-shoot firing head 600 is formed by or in response to rotatably coupling the housing 602 of plug-shoot firing head 600 to the housing 302 of lower perforating gun 300B and rotatably coupling the housing 302 of lower perforating gun 300B with the housing 102 of switch sub 100. Thus, in order to assemble switch sub 100, lower perforating gun 300B, and plug-shoot firing head 600, the charge tube cable 346 of lower perforating gun 300B does not need to be electrically wired (e.g., by personnel of completion system 10) to either gun switch 120 or combination switch 620.

In this embodiment, tool string 20 is configured such that the switches 120, 520, 620 may be reused following the firing of perforating guns 300A, 300B. Particularly, multi-contact bulkhead connector 160 and the single-contact bulkhead connector 220 of switch sub 100 shield gun switch 120 from the pressure (which may exceed 20,000 pounds per square inch (PSI) in some applications) released following the detonation of the shaped charges of perforating guns 300A, 300B by inhibiting or preventing the communication of fluid pressure from perforating guns 300A, 300B to the switch receptacle 112 of housing 102, thereby preventing damage from occurring to gun switch 120 from the activation of perforating guns 300A, 300B. Additionally, biased bulkhead connector 560 and the single-contact bulkhead connector 220 of direct connect sub 500 shield safety switch 520 from the pressure released following the detonation of the shaped charges of perforating guns 300A, 300B by inhibiting or preventing the communication of fluid pressure from perforating guns 300A, 300B to the switch receptacle 514 of housing 502, thereby preventing damage from occurring to safety switch 520 from the activation of perforating guns 300A, 300B. Further, in some embodiments, igniter assembly 700 comprises a pressure bulkhead such that multi-contact bulkhead connector 160 of plug-shoot firing head 600 and the pressure bulkhead of igniter assembly 700 shield combination switch 620 from the pressure released following the detonation of the shaped charges of perforating guns 300A, 300B by inhibiting or preventing the communication of fluid pressure from perforating guns 300A, 300B to the switch receptacle 614 of housing 602, thereby preventing damage from occurring to combination switch 620 from the activation of perforating guns 300A, 300B.

Due to the protection afforded to switches 120, 520, and 620 by pressure bulkheads 160, 560 and the pressure bulkhead of igniter assembly 700, switches 120, 520, and 620 may be reused following the perforation of casing string 12 by perforating guns 300A, 300B so that switches 120, 520, and 620 may be employed in a plurality of separate and distinct completion operations. Given that the cost of manufacturing switches 120, 520, 620 may be relatively expensive compared to the cost of manufacturing the other components of switch sub 100, direct connect sub 500, and plug-shoot firing head 600, the ability to reuse switches 120, 520, 620 may reduce the cost of operating tool string 20 and perforating casing string 12. In some embodiments, pressure bulkheads 160, 560 and the pressure bulkhead of igniter assembly 700 may be sacrificial, and thus, not reused for multiple completion operations.

Referring still to FIGS. 1-5, following the assembly of tool string 20, tool string 20 is lowered though to a desired or predetermined depth or axial position 17 (shown in FIG. 1) within wellbore 4 of completion system 10. In some embodiments, CCL 26 of tool string 20 may be utilized to assist in determining when tool string 20 is disposed in the predetermined position 17 in wellbore 4. In an embodiment, once tool string 20 is disposed in the predetermined position 17, a first or enabling signal is transmitted from control system 15 to an electronic shunt (e.g., an FET) of electrical circuit 524 of the safety switch 520 of direct connect sub 500 via wireline 22, which actuates safety switch 520 into a closed configuration by closing the electronic shunt of the safety switch 520 such that signal and/or data communication is permitted between control system 15 and electrical components of tool string 20 positioned downhole of safety switch 520 (e.g., detonator assemblies 400A, 400B, gun switch 120, combination switch 620, etc.). Thus, prior to being activated by the transmission of the first signal from control system 15, safety switch 520 acts to prevent signal and/or data communication between control system 15 and electrical components of tool string 20 positioned downhole of safety switch 520 to thereby prevent the inadvertent activation or firing of components positioned downhole of safety switch 520.

In this embodiment, following the actuation (via the closing of the FET in this example) of the safety switch 520 into the closed configuration, a second or enabling signal is transmitted from control system 15 to the combination switch 620 of plug-shoot firing head 600 via wireline 22 to enable combination switch 620 and thereby actuate combination switch 620 from an "open" configuration into a "closed" configuration. A third or arming signal is then transmitted from the control system 15 to the combination switch 620 via wireline 22 to arm combination switch 620 for initiating an igniter of igniter assembly 700 by closing an electronic shunt (e.g., an igniter FET) of the electrical circuit 624 of combination switch 620 which thereby completes a circuit path to the igniter of igniter assembly 700. A firing signal comprising electricity or electrical energy is then transmitted from control system 15 down wireline 22 to igniter assembly 700 to initiate the igniter of igniter assembly 700 and thereby actuate setting tool 30 and set frac plug 34 whereby fluid communication across frac plug 34 is restricted.

In this embodiment, following the actuation of setting tool 30 and the setting of frac plug 34, a fourth or arming signal is transmitted from the control system 15 to the combination switch 620 via wireline 22 to arm combination switch 620 for initiating the detonator 402 of lower detonator assembly 400B by closing an electronic shunt (e.g., a detonator FET) of the electrical circuit 624 of combination switch 620, thereby completing a circuit path to detonator 402. A firing signal comprising electricity or electrical energy is then transmitted from control system 15 down wireline 22 to the detonator 402 of lower detonator assembly 400B to thereby initiate detonator 402. The initiation of detonator 402 of lower detonator assembly 400B detonates the explosive shaped charges of lower perforating gun 300B, forming a first or lower set of perforations in casing string 12.

In this embodiment, following the detonation of the shaped charges of lower perforating gun 300B, a fifth or enabling signal is transmitted from control system 15 to the gun switch 120 of switch sub 100 to enable gun switch 120. A sixth or arming signal is then transmitted from the control system 15 to the gun switch 120 via wireline 22 to arm gun switch 120 for initiating the detonator 402 of upper detonator assembly 400A by closing an electronic shunt (e.g., a detonator FET) of the electrical circuit 124 of gun switch 120, thereby completing a circuit path to detonator 402. A firing signal comprising electricity or electrical energy is then transmitted from control system 15 down wireline 22 to the detonator 402 of upper detonator assembly 400A to thereby initiate detonator 402. The initiation of detonator 402 detonates the explosive shaped charges of upper perforating gun 300A, forming a second or upper set of perforations in casing string 12 that are spaced from the lower set of perforations formed by lower perforating gun 300B. In this embodiment, following the detonation of the shaped charges of upper perforating gun 300A, tool string 20 (sans frac plug 34) is retracted from wellbore 4 and the formation 6 is hydraulically fractured via a fluid delivered to formation 6 via the upper and lower sets of perforations formed in casing string 12 by perforating guns 300A, 300B.

In some embodiments, tool string 20 is retrieved from the wellbore 4 and gun switch 120 is recovered from the tool string 20. The gun switch 120 may be inspected (e.g., at the wellsite at which wellbore 4 is located and/or at a location distal the wellsite) to verify that, following the detonation of the explosive shaped charges of perforating guns 300A, 300B, the gun switch 120 is intact and operable for reuse with a new tool string that is different from tool string 20.

In another embodiment, the new tool string (which may be similar to tool string 20) is assembled to include one or more new perforating guns (different from perforating guns 300A, 300B of tool string 20) each having one or more new perforating charges located therein (e.g., a first new perforating charge located in a first new perforating gun, a second new perforating charge located in a second perforating gun, etc.). The new tool string is also assembled to include the original gun switch 120 which is connected to at least one of the new perforating guns of the new tool string whereby the original gun switch is placed in communication (e.g., ballistic communication) with the one or more new perforating charges of at least one of the one or more new perforating guns of the new tool string. The original gun switch may be located internally or externally of the new perforating gun to which it is connected. Additionally, the assembly of the new tool string may occur at the location of the wellbore or at a location that is remote from the wellbore.

In another embodiment, the assembled new tool string is inserted into a wellbore (which may be the same as, or different from, the original wellbore 4) and a signal may be delivered to the original gun switch 120 to initiate a detonation of at least one of the new perforating charges of the new tool string. The new tool string may then be retrieved from the wellbore and the original gun switch 120 may be retrieved from the new tool string. In some embodiments, the original gun switch 120 may be inspected following the detonation of the at least one new perforating charge to verify that the original gun switch 120 may be reused with a third tool string which is different from both tool string 20 and the new tool string.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tool string for perforating a tubular string positioned in a wellbore, comprising:

a perforating gun comprising one or more shaped charges;

a setting tool coupled to the perforating gun;

a downhole plug coupled to the setting tool and shiftable between a first configuration in which fluid communication across the plug is permitted and a second configuration in which fluid communication across the plug is restricted in response to activation of the setting tool; and a combination switch coupled to at least one of the perforating gun, the setting tool, and the downhole plug, the combination switch configured to both detonate the one or more shaped charges of the perforating gun in response to receiving a first firing signal and to activate the setting tool to shift the downhole plug from the first configuration to the second configuration in response to receiving a second firing signal.

2. The tool string of claim 1, wherein the second firing signal is separate from the first firing signal.

3. The tool string of claim 1, wherein the combination switch comprises a digital switch.

4. The tool string of claim 1, wherein the combination switch comprises a printed circuit board (PCB) and an electrical circuit formed on the PCB.

5. The tool string of claim 4, wherein the electrical circuit comprises a processor and a memory.

6. The tool string of claim 1, further comprising an outer housing having an interior that receives the combination switch, the outer housing coupled to at least one of the perforating gun, the setting tool, and the downhole plug.

7. The tool string of claim 6, further comprising a firing head comprising the outer housing and the combination switch, the firing head coupled between the perforating gun and the setting tool.

8. The tool string of claim 1, further comprising a cable head for connecting to a wireline cable, wherein the combination switch is positioned along the tool string between the cable head and the downhole plug.

9. A tool string for perforating a tubular string positioned in a wellbore, comprising:

a perforating gun comprising one or more shaped charges;

a setting tool coupled to the perforating gun;

a downhole plug coupled to the setting tool and shiftable between a first configuration in which fluid communication across the plug is permitted and a second configuration in which fluid communication across the plug is restricted in response to activation of the setting tool; and a switch assembly comprising an outer housing coupled to at least one of the perforating gun, the setting tool, and the downhole plug, and a combination switch received in the outer housing and configured to selectably detonate the one or more shaped charges of the perforating gun and to activate the setting tool to shift the downhole plug from the first configuration to the second configuration.

10. The tool string of claim 9, further comprising a firing head comprising the outer housing and the combination switch, the firing head coupled between the perforating gun and the setting tool.

11. The tool string of claim 9, wherein the combination switch comprises a digital switch.

12. The tool string of claim 9, wherein the combination switch comprises a printed circuit board (PCB) and an electrical circuit formed on the PCB.

13. The tool string of claim 12, wherein the electrical circuit comprises a processor and a memory.

14. The tool string of claim 9, wherein the combination switch is housed entirely within the outer housing.

15. The tool string of claim 9, further comprising a cable head for connecting to a wireline cable, wherein the switch assembly is positioned along the tool string between the cable head and the downhole plug.

16. A method for perforating a tubular string positioned in a wellbore, comprising:

(a) lowering a tool string into a first wellbore, the tool string comprising a perforating gun, a setting tool, a downhole plug, and a combination switch configured to activate both the perforating gun and the setting tool;

(b) activating by the combination switch the setting tool in response to the combination switch receiving a first firing signal whereby the setting tool shifts the downhole plug in the wellbore from a first configuration in which fluid communication across the plug is permitted to a second configuration in which fluid communication across the plug is restricted; and (c) activating by the combination switch the perforating gun in response to the combination switch receiving a second firing signal whereby one or more shaped charges of the perforating gun are detonated by the combination switch.

17. The method of claim 16, wherein (c) occurs at a later point in time than (b).

18. The method of claim 16, wherein the second firing signal is different from the first firing signal.

19. The method of claim 16, wherein the combination switch comprises a digital switch.

20. The method of claim 16, further comprising:

(d) transmitting the first firing signal from a surface controller to the combination switch; and (e) transmitting the second firing signal from the surface controller to the combination switch.

* * * * *